United States Patent [19]

Margolin et al.

[11] 4,249,552

[45] Feb. 10, 1981

[54] AUTOMATIC MONEY HANDLING DEVICE

[75] Inventors: George D. Margolin, Newport Beach; Victor V. Vurpillat, Laguna Niguel, both of Calif.

[73] Assignee: Auto Register, Inc., Costa Mesa, Calif.

[21] Appl. No.: 957,913

[22] Filed: Nov. 6, 1978

[51] Int. Cl.[3] ..... G07D 1/06

[52] U.S. Cl. ..... 133/1 R; 133/2; 194/2; 271/272

[58] Field of Search ..... 194/1 R, 1 N, 1 M, 2, 194/4, 10; 133/1 R, 2; 271/272, 275

[56] References Cited

U.S. PATENT DOCUMENTS

| | | | |
|---|---|---|---|
| Re. 29,178 | 4/1977 | Colwill | 271/3.1 X |
| 3,064,785 | 11/1962 | Weingart | 194/4 F |
| 3,222,057 | 12/1965 | Couri | 194/4 R X |
| 3,683,943 | 8/1972 | De Crepy | 194/4 R X |
| 4,034,838 | 7/1977 | Uchida | 194/4 R |

*Primary Examiner*—Joseph J. Rolla
*Attorney, Agent, or Firm*—David S. Woronoff

[57] ABSTRACT

An automatic money handling device for receiving bills and coins and for dispensing bills and coins as change. The device has a storage reel, first and second bill belts extending from a first and supply reels around a first and second entrance rollers at an opening to the housing then to the storage reel. The two belts converge at the entrance rollers and then extend in superposed relation from the entrance rollers to the supply reel. Reversible drives can cause the belts to travel toward and away from the opening for receiving, dispensing and storing bills. A first sensor outside the opening senses the presence of a bill and can control the operation of the drive motors. A second sensor inside the housing adjacent the entrance rollers senses if and when the bill has been drawn far enough into the webs and halts operation of the forward drive, thus positioning a tendered bill at a viewing station for inspection. The second sensor is an optical sensor for causing any bill not having a predetermined opacity to be rejected. A time delay is provided for halting forward drive of the belts if a bill tendered does not reach the second sensor within the preset time period.

22 Claims, 25 Drawing Figures

CONTROL SIGNAL DECODER 420
RLSC
CQENZ
FLSC
CQNL1
CL1
CQNL0
CL0
CQEN1
CQNN1
CQEN0
CQNN0
CSTB
CQEN1
CQEN0
CQEN0
CQEN1
CQEN1
CQEN0
ENBA
KSW
VI
UNLD
RUN
LMP
FWD
REV
D
C
CLR
Q
431
432
435
421
422
425
433
423
426
434
427
430
424
439
428
442
436
441
437
438
440
429

AUTOMATIC MONEY HANDLING DEVICE

CROSS REFERENCES TO RELATED APPLICATIONS

The present invention is related to two other patent applications filed on the same date as the present application, Nov. 6, 1978, all of which are assigned to a common assignee. These applications are Point of Sale Terminal Having Prompting Display and Automatic Money Handling invented by Nor is S. Azcua, George D. Margolin, Audrey Miller and Victor V. Vurpillat, Ser. No. 957,914 and Point of Sale Terminal Having Prompting Display Ser. No. 957,912 invented by the same four inventors listed above.

SUMMARY OF THE INVENTION

The present invention relates to a device for semi-automatically handling money, coins and bills, coupons, certificates and similar items. The device has a computer device to control one or more movable bill belts in response to signals received from bill detectors placed along the bill's path as it moves from outside the bill belts to a position sandwiched between the bill belts. The bill belts are driven in both forward and reverse directions by motors controlled by the sensors and the computer. The device has a housing with a viewing window, a keyboard and an inlet-outlet channel. The bill belts transport the tendered bill to the viewing window for identification and verification by the device operator. The operator then actuates an accept key or reject key to indicate if the tendered bill is accepted. If the bill is rejected by the operator, keying the reject key causes the belts to be driven in the reverse direction to return the bill to the customer.

One embodiment of the present invention has four bill belts. Each belt mechanism is independently driven by separate motors but commonly controlled by one computing control device. Each belt mechanism has its own sensors, viewing window, inlet-outlet channel and accept and reject keys. Each belt is controlled so that it can't be "teased" by a customer tendering a bill and then withdrawing it. If a bill is not detected within a fixed time period by the second sensor, the belt motors are stopped. This anti-tease function saves belt storage space and prepares the device to accept a valid transaction.

The bill belts in one embodiment of the invention have designated inputs: a $1 belt, a $5 belt, a $10/$20 belt, and a coupon, certificate and related document belt. Each belt is transparent and has a first bill detector adjacent the input-output channel to the belt and a second detector along the viewing path in between the input-output channel and the viewing window. A third bill detector may be used on the opposite side of the viewing window.

Because the bill belts can be driven in both forward and reverse directions, money can be dispensed as change by the device. However, in one embodiment of the present invention, only the $1 and $5 bill belts can be operated as bill dispensers; although all bill belts can reject unacceptable bills.

If more than one bill belt is employed, a signal light can be placed in the housing near the viewing window to indicate which belt is in operation so that the operator can look for a tendered bill in the proper viewing window. The belts can be controlled so that only one bill belt at a time can be active. The motors can be controlled so that the bill belt dispenses bills to the inlet-outlet channel but requires the customer to remove the bill or the last bill as change in order to have the controller proceed to the next step in the transaction. In one embodiment of the present invention the sensors are separated by a distance less than one bill length and the entire viewing path along the top of the housing is about two bill lengths.

DETAILED DESCRIPTION

INTRODUCTION

The present invention provides a point of sale terminal for automatically calculating a payment due for a sales transaction and for receiving money tendered in payment and for dispensing change. The system includes a data processing subsystem comprising at least one computer, a memory which may include a read-only memory (ROM) and a random-access memory (RAM); a keyboard; and a customer-fed money storage and pay-out device. The keyboard includes a group of item-representing keys, preferably for those items having the highest volume of sales. The terminal also includes a prompting display for prompting the operator to key in item-identification data. A computer receives such item-identification data, retrieves from the memory price data for each keyed item, and calculates the total price of the transaction. The money handling device has a plurality of customer-fed bill belts for receiving, storing and dispensing bills of different denominations, as well as for receiving checks, coupons, and the like. The money handling device includes a coin receiver, storer, sorter and dispenser. The bill and coin devices operate under control of one or more computers to receive money and to dispense change. A digital display subsystem operating under control of a computer displays the amount of sale and the amount tendered. A printer provides a printout of sales data and data identifying the attendant responsible for each transaction.

Figure 1:
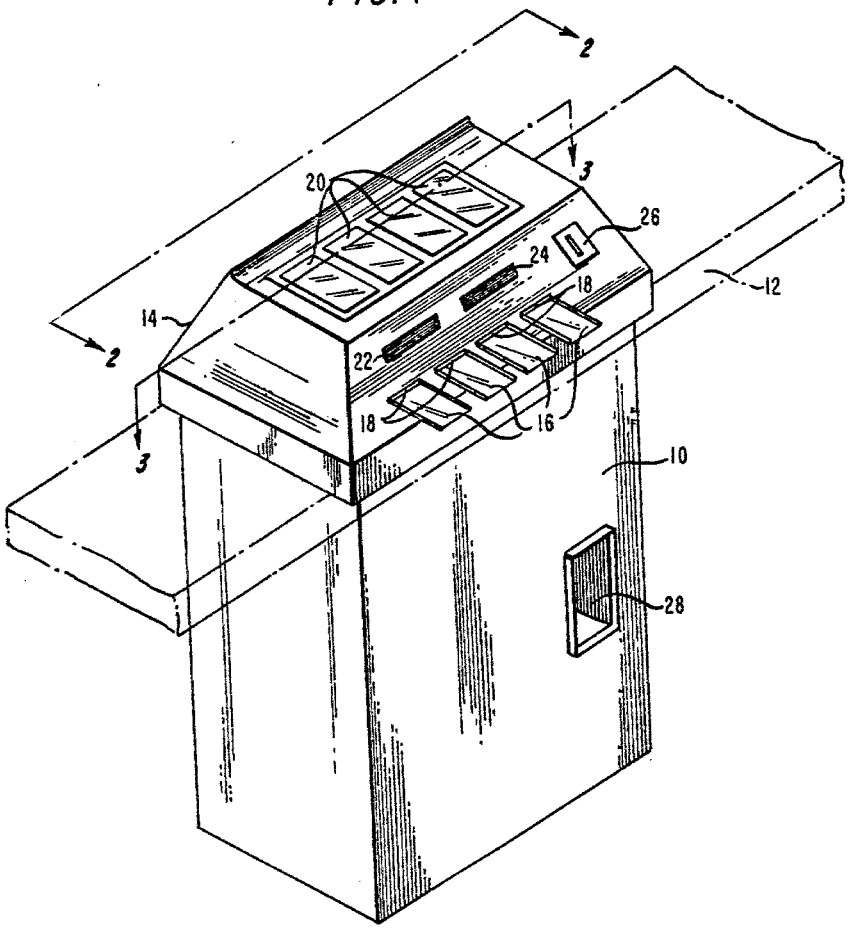
FIG. 1 shows a top perspective view of the housing forming a part of one embodiment of the present invention.
Figure 2:
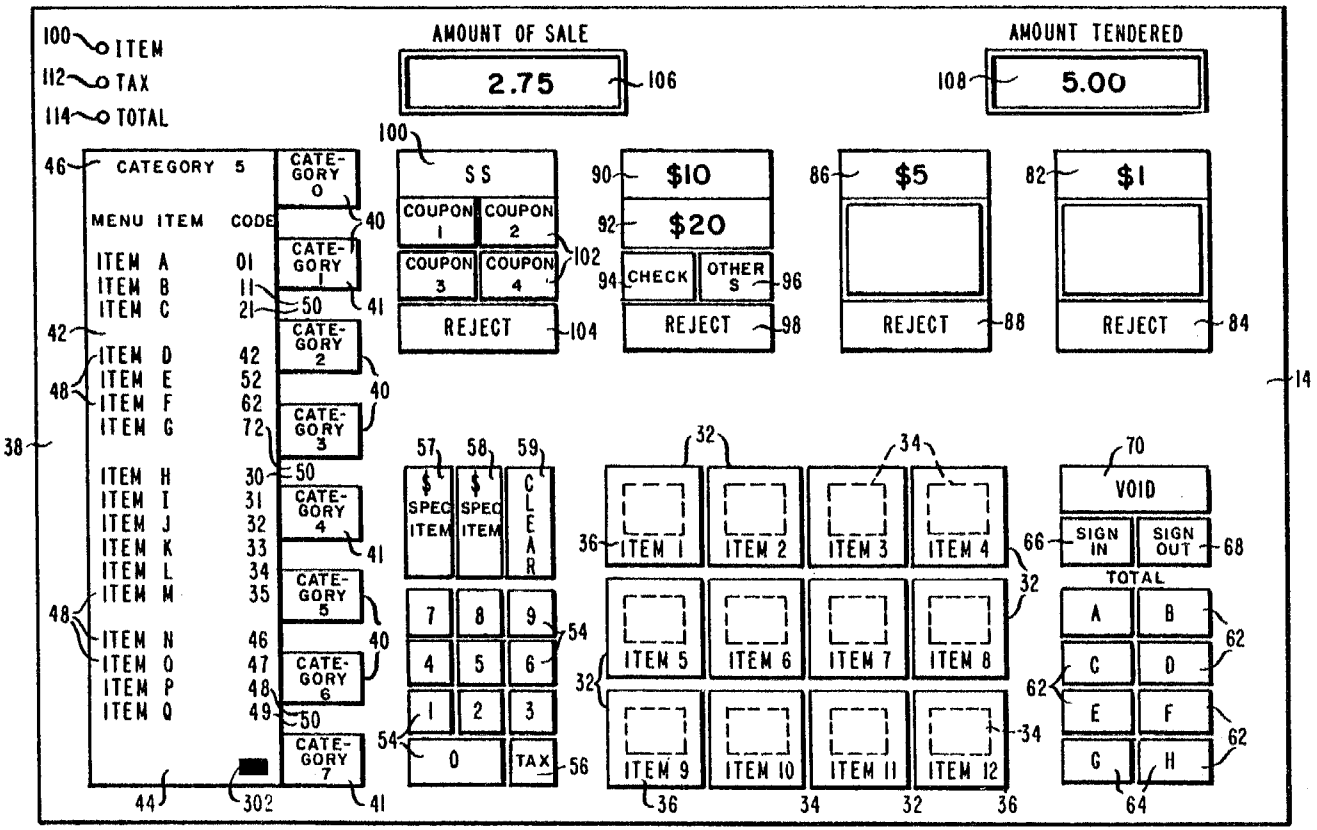
FIG. 2 shows a keyboard forming a part of the present invention.
Figure 3:
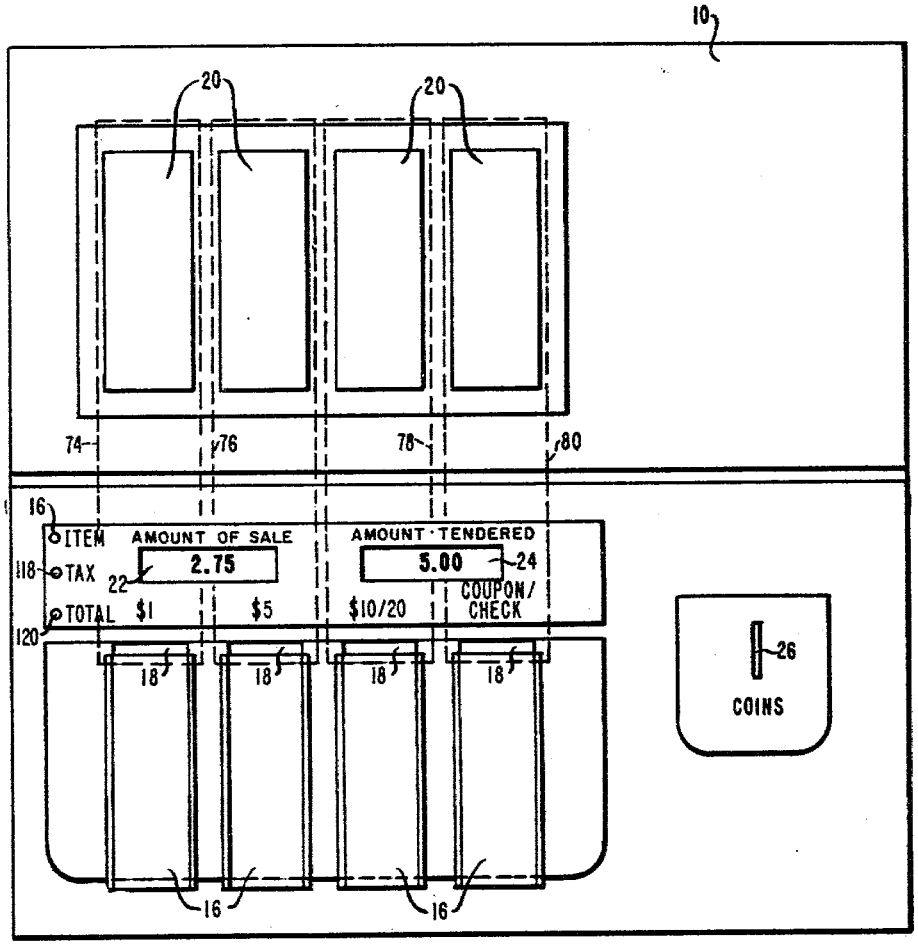
FIG. 3 shows the bill trays and viewing windows forming part of the present invention.

FIGS. 1 and 3 illustrate housing 10 having an interior for containing electromechanical and electronic apparatus. An upper portion of the housing has an exterior face 11 with a keyboard 14 on one side 13 of the housing. The keyboard shown in FIG. 2 is described in detail in a separate section.

The upper portion of a customer side 15 of the housing has an exterior face 17 for access to a series of four side-by-side customer-fed bill belt devices. Each bill belt device is a separate electro-mechanical device subject to common control. In a separate section there is a detailed description of an individual bill belt. Each bill belt communicates with a corresponding one of four money trays 16 projecting outwardly from the customer side of the housing 10. Each bill belt device has an inlet/outlet channel at the junction between the tray and the housing. Bills despensed as change or rejected are received in the money trays 16.

Four side-by-side windows 20 are provided on a top portion of the housing for viewing from both the attendant side 13 and the customer side 15 of the housing. Each bill belt is aligned with one of the windows 20 so that a bill sandwiched between the bill belts can be viewed by an operator.

The customer side is of the housing 10 includes digital displays 22 and 24. Display 22 shows the total amount of each sales transaction and display 24 shows the amount tendered by the customer. A coin slot 26 and a coin receptacle 28 are located on the customer side of the housing 15.

There are on the keyboard: a group of Total keys by which each operator can enter data that the computer recognizes as both transaction data and employee-identification data; and a group of Accept and Reject keys by which an operator can control the bill belts.

A feature of the present invention is that the attendant need not remember the price of any item ordered by a customer. Having received the customer's order, the attendant simply actuates the appropriate keys either item keys or category and number keys as prompted by the prompting display to key in item-identification data. In response, the data processor retrieves from memory the corresponding price data, and displays it on 22. After all the ordered items have been entered, the operator actuates the proper Total key to conclude the order phase of the sales transaction. The next phase of the sales transaction involves the calculation and display of payment-due data. In as much as the data entered by the Total key provides employee-identification the computer can update an activity record stored in the memory. Such an activity record is particularly useful to evaluate performance of employees.

After the payment-due has been calculated, the computer arms the money belts either directly or through another computer or controller. An attempted deposit of money by a customer prior to such arming will prove fruitless. Prior to arming, any coin deposited in the coin slot 26 drops down a chute to coin receptacle 28 for return to the customer. Deposit of a bill into the unarmed bill belts will leave the bill in the tray 16. This feature minimizes the possibility of disputes, since it is a simple matter to demonstrate that money cannot be fed into the unarmed money receptacles.

Once armed the terminal enters a pay-in mode. Now, when the customer drops a coin into coin slot 26 it will be sorted and stored on the basis of denomonation. Each bill tendered is transported to the window 20 for viewing. If the customer tenders an unacceptable bill, the attendant can cause it to be returned to the customer by actuating the appropriate reject key 84, 88, 98, 104. If the visual test is passed, the attendant actuates an Accept key. The computer is responsive to successive actuations of the Accept keys after a bill is sensed to accumulate and display a running total of the amount of money accepted.

The computer determines whether any change is due to the customer. If no change is due to the customer, the data processor disarms the money handling apparatus. If change is due, the system enters a change-dispensing mode during which either or both coins and bills are dispensed. In either case a printer produces a record of the transaction.

KEYBOARD

The keyboard illustrated in FIG. 2 includes a group of individual item-representing keys 32, or Best Seller keys. In the illustrated embodiment there are twelve Best Seller keys 32 in the group. Each Best Seller key preferably has a corresponding pictorial representation, (illustrated in phantom lines at 34 on each key) of the item associated with that particular key, together with a separate label 36 printed on each key describing the item associated with that particular key. The labels 36 relating to the items identified by the twelve Best Seller keys are indicated in the drawings as Item 1 through Item 12 for simplicity.

The keyboard 14 also includes a prompting display 38 for displaying product category and corresponding item-listing information for the less frequently sold items and for the Best Seller items the prompting display provides data for prompting the attendant to actuate certain keys on the keyboard to identify to the data processor corresponding less-frequently sold items being sold at the point of sale.

In the illustrated embodiment, a series of eight mutually spaces apart Category keys 40 are positioned alongside a widnow 42 which covers the prompting display and through which the prompting display can be viewed. Each category key has a corresponding label 41 for identifying a category of information to which the key corresponds. The prompting display includes a movable roll 44. An electro-mechanical drive apparatus is provided for moving the roll 44. Each category and its related list of items is printed on the roll. A selected portion of the roll can be moved to the window 42 for display when the attendant actuates a particular Category key 40. For example, in the embodiment shown a category heading 46 entitled "CATEGORY 5" displays a listing of corresponding individual items 48, depicted as "ITEM Q"; and when the attendant manually actuates the category key 40 labeled "CATEGORY 5" the roll 44 is moved until the listing for CATEGORY 5 is displayed in the window 42.

The roll shows a separate item-identifying code 50 unique to each item listed in the prompting display. In the illustrated embodiment the prompting indicia for each item is a two-digit number displayed on the roll next to the item.

A group of numeric keys 54, hereafter collectively called a numeric pad, are positioned on the keyboard next to the prompting display 38. The numeric pad preferably comprises ten individual keys labeled 0 through 9, respectively, with an eleventh key 56 labeled "TAX", for identifying taxable items. The numeric pad can be used to identify to the data processor items selected from the prompting display. To identify each item selected from the prompting display, first a category key is actuated and then two of the numeric keys are actuated in an order which supplies to the data processor a three-digit number for identifying the selected item. For example, to indicate ITEM J in CATEGORY 5 first the CATEGORY 5 key is actuated and then the numeric keys are actuated in the sequence 3,2 for supplying a corresponding three-digit number(5,3,2) to the data processor for identifying ITEM J.

The prompting display roll preferably contains a listing of all available items for sale. Owing to this preferred feature, "redundancy" is provided in that items represented on the Best Seller keys 32 are also represented on the roll.

By way of example, in the course of the order-entry phase of a sales transaction involving the sale of one or more best seller items and one or more less frequently sold items, separate item-representing keys 32 are actuated to indicate purchase of each best seller item. The prompting display is actuated to display information relating to each item not represented on the Best Seller keys, and in a sequence prompted by the prompting display, the numeric keys 54 are actuated to indicate a separate multi-digit code for each less frequently sold item displayed on the prompting display. Data processor subsystem includes a look-up table for retrieving a pre-loaded price for each item identified in the order-entry phase of the sales transaction. The Tax button 56 is actuated after each taxable item is indicated and the data processing subsystem calculates the tax on each taxable item. An arithmetic unit in the data processor sums the individual prices of each identified item, as well as the tax on each item, so as to calculate the total price of the sale transaction.

The keyboard includes Total keys 62. In the illustrated embodiment, there are eight Total keys having indicia 64 suitably the letters A through H. In response to the actuation of any one of the Total keys during a sales transaction, the computer calculates the payment due.

Above the group of numeric keys there is a first Special-Item key 57. This key is used to enter into the data processor. concerning the sale of special items not otherwise identifiable by the item-representing keys 32 or the category information in the prompting display 38. The data processor can be programmed so that when the Special-Item key 57 is actuated, followed by entry of the sale amount, in cents, on the numeric keys 54, the sale can be recorded, along with its identification as a special item by selection of the next keyboard entry. If this is the last or only sale entry, then actuation of a corresponding Total key 62 can record the sale.

A second Special-Item key 58 above the group numeric keys can be used to enter the sale of gift coupons. The data processor can be programmed so that when the second Special-Item key is actuated, followed by entry of the same amount on the numeric keys, 54, the sale is recorded and identified in a manner similar to the first Special-Item key described above.

A Clear key 59 is located above the group of numeric keys 54. The Clear key is used for clearing the last entry made.

A Sign-In key 66 and a Sign-Out key 68 are located on the keyboard above the Total keys 62. The Sign-In Key is manually actuated by each attendant to indicate when he or she is starting a work shift and to assign a separate attendant identification code to each attendant. An attendant starting a work shift can depress the Sign-In key, enter his or her three digit attendant number on the numeric pad 54, and depress his or her assigned Total. key 62 for indicating his or her code for that particular work shift. Once a particular Total key is assigned to an attendant by the sign-in procedure, that particular Total key is unavailable for being assigned to another attendant until the Sign-Out key is actuated to release use of the key for an attendant working a subsequent work shift.

The Sign-Out key 68 is manually actuated to cause the data processor to record the times when the attendants end their respective work shifts, as well as for releasing the Total key code assigned to each attendant ending a work shift. Attendants ending their work shift sign out by actuating the Sign-Out key, entering their employee number on the numeric keys 54, and entering their assigned code on one of the Total keys 62.

A Void key 70 is provided on the keyboard above the Sign-In and Sign-Out keys. The Void key is used to clear from the data processor all data entered from the start of a given sales transaction. The Void key becomes inoperative after arming of the bill caches.

Above each bill belts' opening are respective labels 72 indicating the type of paper currency or money equivalent to be inserted into the opening of each bill belt: 10. One dollar bills for a first bill belt 74; five dollar bills for a second bill belt 76; either $10 or $20, checks or ether bills for a third bill belt 78; and other bills, checks, coupons etc, for a fourth bill belt 80. The fourth bill belt is adapted for receipt of promotional items.

Each group of Accept/Reject keys as shown in FIG. 2 includes one or more keys labeled according to the type of bill, coupon, check, etc., to be received by a corresponding bill belt. A first group of Accept/Reject keys associated with the first bill cache 74 includes a One Dollar Accept key 82 and a One Dollar Reject key 84.

The second group of Accept/Reject keys comprises a Five Dollar Accept key 86 and Reject key 88.

A third group of Accept/Reject keys includes a Ten Dollar Accept key 90, a Twenty Dollar Accept key 92, a Check Accept key 94, an Other Dollar Accept key 96, a reject key 98 for rejecting any of the bills in the third bill belt.

Above a fourth group of Accept/Reject keys, there is a special function key 100 labeled "SS" for entering acceptance of special transactions not covered elsewhere on the keyboard. The fourth group comprises a set of four keys 102 for indicating acceptance of four different types of coupons or similar store promotion certificates. A Reject key 104 enters rejection of any coupon certificate or the like tendered into the fourth bill cache.

Operation of the Accept/Reject keys is understood best by the following example. After having entered data relating to all items involved in a single order, the attendant depresses his or her assigned Total key 62 to calculate and display the amount of sale, i.e., the payment due. Payment is made by the customer by inserting coins into the coin slot 26 and/or bills, checks, coupons or the like into appropriate openings 18. Upon tendering of a bill to any opening 18 a light identifying the active bill belt cues the attendant to look to the proper window 20. The attendant then visually inspects the tendered bill. Upon verification, the attendant depresses the appropriate One, Five, Ten, Twenty key. Actuation of any of these keys indicates the amount of payment made against the total same amount.

When payment of an amount equal to or greater than the amount of sale is detected by the data processor, the required amount of change, if any is automatically calculated and dispensed by the coin, the one dollar and five dollar bill devices as required. No change is given from other than the one or five dollar bill belts and the coin changer. Recording of receipts and disbursements by denomination, along with the store-opening amounts, enable the system to maintain an accurate account of all bills and coins throughout the business day. Customer submittal of checks or other bill denominations (two dollars, fifty dollars, etc.) is verified by the attendant examining the dollar or check amount through the corresponding window 20. If the tendered bill or check is acceptable, the attendant then enters the amount of the bill or check, using the numeric keys 54. Subsequent actuation of either the Check key or the Other dollar key 96 identifies the type and amount of payment to the data processor.

Actuation of the "SS" keys 100 provides a means to record and identify special transactions, such as discounts, give-aways, no charge sales, etc. Under these conditions the bill belts are not activated. Actuation of the SS key, preceded by entering the amount on the keys 54 enters an amount to be deducted from the total sale and recorded as expense.

The coupon keys 102 labeled Coupon 1 through Coupon 4 can be used to identify different types of promotional sales. Actuation of this key can cause the data processor to accept the value previously entered on the numeric keys 54, to identify the sale as resulting from a store promotion, and to enter in memory the cash value of the promotion to be used later on cash reconciliation.

The keyboard includes a first digital display 106 for displaying the amount of sale of each sales transaction, and a second digital display 108 for displaying the cumulative amount tendered in payment of each sales transaction. Display 106 can be used to momentarily display the price of each item sold and the tax on each item sold. The keyboard also includes a first LED 110 for being activated when display 106 relates to the price of a particular item being sold; a second LED 112 for indicating the tax on either the amount previously displayed or the total tax; and a third LED 114 to be activated display 106 indicates the total amount of the sales transaction, including tax.

On the customer side 15 of the housing 10, as illustrated in FIG. 3, the digital displays 22 and 24 provide the same displays as the amount of Sale display 106 and the Amount Tendered display 108, respectively. Similarly, LED displays 116, and 120 on the customer side 15 of the housing are activated along with corresponding activation of the LED's 110, 112, and 114 for corresponding item, tax and total information, respectively.

In a specific embodiment, in which the keyboard 14 is adapated for use in a point of sale terminal involving the sale of ice cream products, all keys on the keyboard are a flattouch type which can be wiped clean with a damp cloth and which have no openings through which liquids can reach the switching mechanisms. Switches are mechanical, rather than capacitive, in order to minimize accidental activation.

BILL HANDLING

Figure 4:
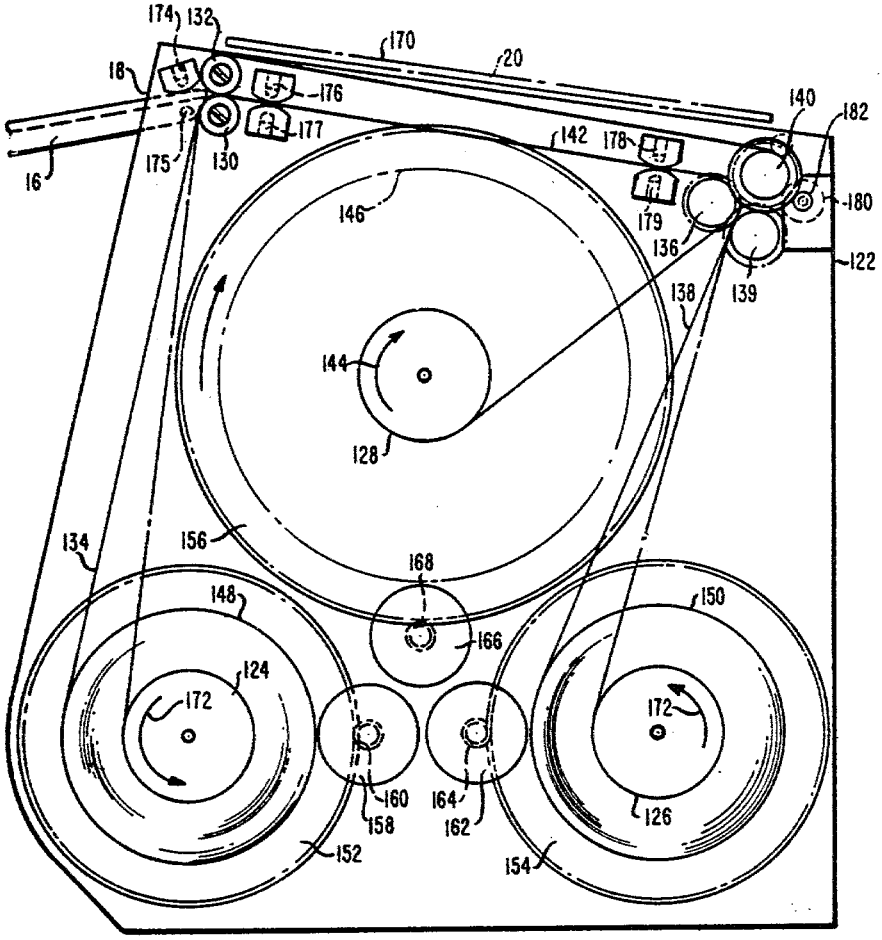
FIG. 4 shows an axial view of the bill belt mechanism forming a part of the present invention.
Figure 5:
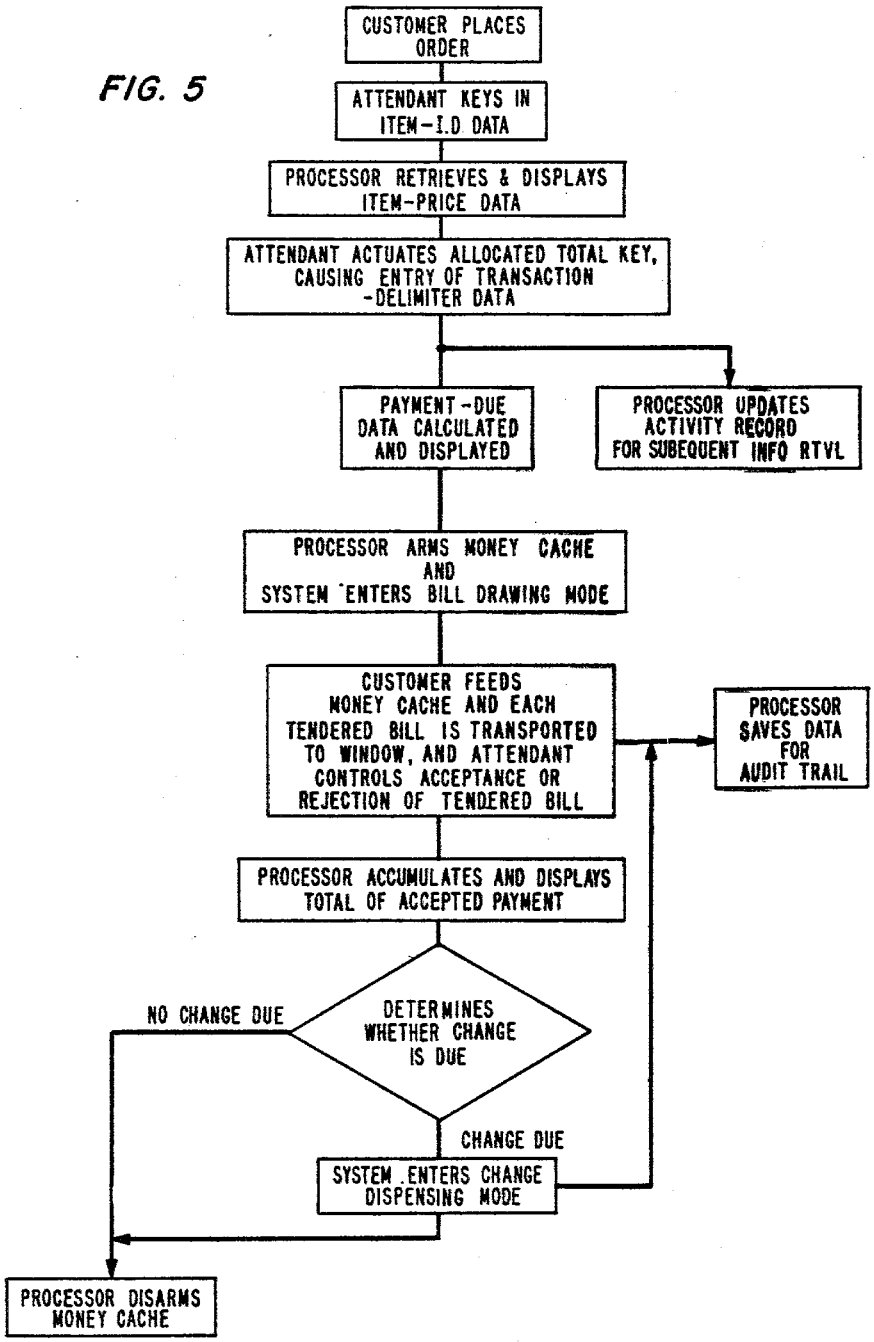
FIG. 5 shows the basic steps performed by the operator and the terminal during a sale.

The construction of each bill belt device is shown in FIG. 4. Each bill belt device includes a housing 122 containing a first and second supply unstoring reels 124, 126 spaced apart from each other, and a take-up or storage reel 128. A lower entrance roller 130 is located immediately inside the housing 122 below the opening 18 and an upper entrance roller 132 is located immediately inside the housing 122 above the opening 18 and above the lower entrance roller 132. The two entrance rollers are rotatable about corresponding axes of rotation which are parallel to one another and perpendicular to the path of travel of a bill inserted into the opening of the bill cache.

A first transparent money belt 134 is secured at one end to the first supply reel 124 and is secured at its opposite end to the storage reel 128. The first belt has a portion extending upwardly away from the first supply reel, around the lower entrance roller, and then along a straight path away from the entrance rollers and around a first guide roller 136 on a side of the housing opposite the entrance roller. Such portion of the first belt then extends from the first guide roller down to the storage reel 128. A second transparent money belt 138 has a portion extending upwardly from the second supply reel 126 into engagement with a second guide roller 139 adjacent the first guide roller 136 and then around a third guide roller 140 above the second guide roller. Such portion of the second belt then extends along a straight path near the top of the housing toward the entrance to the bill cache and is wrapped around the upper entrance roller 132 and is then reversed to travel in a superposed relation above the portion of the first web which extends in a straight path across the top of the housing. The superposed path of the first and second belts is illustrated at 142 in FIG. 4 and is referred to below as the viewing path or viewing position. The first and second belts both extend around the first guide roller 136 in their superposed relation and both belts then extend down to the storage reel 128, in the superposed relation, for attachment to the storage reel. The first and second belts are wound in unison around the storage reel when the storage reel is rotated in the direction of the arrow at 144 shown in FIG. 4.

Thus, the first and second belts converge at the entrance rollers which, in turn, apply a slight amount of pressure against one another so that the two belts are pressed slightly into contact with one another as they converge inside the opening 18 to the housing 122. The belts then pass in a superposed relation along the straight viewing path 142 across the upper portion of the housing from the opening 18. The two belts are held in contact with one another along the straight viewing path 142 as they pass around the first guide roller 136 to the storage reel 128.

First and second gear wheels 152, 154 are rigidly affixed to the first and second supply reels 124, 126. The two gear wheels are the same diameter, and have gear teeth of identical size and spacing.

A third gear wheel 156 is rigidly affixed to the storage reel. The third gear wheel has approximately twice the area of either the first or the second gear wheel, and has gear teeth of the same size and spacing as the first and second gear wheels.

A first supply reel drive motor 158 is mounted in the housing 122 adjacent the first gear wheel 152. A first driven gear wheel 160 on the output shaft of the first supply reel drive motor engages the first gear wheel. The first driven gear wheel is substantially smaller in diameter than the diameter of the first gear wheel. Similarly, a second supply reel drive motor 162 is mounted in the housing adjacent the second gear wheel 154, and a second driven gear wheel 164 identical to gear 160 on the output shaft of the second supply reel drive motor engages the second gear wheel. A take-up reel drive motor 166 is mounted in the housing 122 adjacent the third gear wheel 156, and a third driven gear 168 on the output shaft of the take-up reel drive motor engages the third gear wheel.

A servo mechanism is provided for the bill belts.

A computer issues a number of commands to the controller.

When the bill belt is operated in a pay-in mode, its take-up reel drive motor 166 is energized by the servo to rotate the third gear wheel 156 clockwise in the storing direction (with reference to FIG. 4) which, in turn rotates the storage reel 128 in the clockwise direction illustrated by the arrow 144 in FIG. 4. At the same time, the first and second belts unwind from their respective supply reels and travel together, in their superposed relation, along the viewing path 142 away from the entrance rollers and toward the first guide roller 136. Preferably, tension is maintained by applying a relatively low level of energization to the supply reel drive motors 158 and 162 which are electrically connected in series. The bill is drawn into the opening 18 and between the first and second belts by the action of the belts traveling over the entrance rollers and into the housing along the viewing path 142 to a window 20 in the point of sale housing 10. The window 20 is illustrated in phantom in FIG. 4. The drive motors are deenergized, under control of a computer, to position the bill below the window, for viewing by the operator.

As bills continue to be drawn into the housing they become sandwiched between the belts wrapped around the storage reel 128.

When the bill belt is operated in a pay-out mode, its series-connected supply reel drive motors are energized by the servo to turn their respective gear wheels in a counter-clockwise direction in a unstoring direction (with reference to FIG. 4) which, in turn, rotates the supply reels in a counterclockwise direction, as illustrated by the arrows at 172 in FIG. 4. The unstoring direction is the dispensing direction. In the pay-out mode, bills are dispensed. Preferably, tension is maintained by applying a relatively low level of energization to the take-up reel drive motor 166. This travel of the belts causes each bill sandwiched between them to be payed out through the opening 18.

In the illustrated embodiment, the bill belt sensors include outer optical detectors outside the entrance rollers 130, 132 and inner optical detectors inside the housing adjacent the entrance rollers. The outer sensors can be a first infra-red (IR) sensor 174 located in front of the entrance rollers above the opening 18 and a cooperating IR emitter 175 embedded in the money tray 16 in front of the entrance rollers and below the first IR sensor 174. The emitters 175 and 177 are electrically connected in a gate-controlled series circuit path.

The outer optical sensors are located as close to the outside of the entrance rollers as possible. It is desirable that the inner optical sensors also be located fairly close to the inside of the entrance rollers, although they can be spaced inwardly from the entrance rollers no nore than the length of a bill being tendered into the bill cache.

In the bill belt, each of the two emitter and sensor combinations provides for detecting when a bill is present between them. Each sensor senses all the IR radiation transmitted to it from the corresponding emitter when no bill is present between them, and the sensor produces an output signal having a first value proportional to the sensed transmitted IR radiation for indicating that no bill is present. When a tendered bill is present between the sensor and detector, a certain amount of IR radiation is transmitted through the bill, but most transmitted IR radiation is blocked. The sensor produces an output signal having a second value proportion to the reduced amount of sensed transmitted IR radiation for indicating that a bill is present. This capability of the sensors can be used to detect bills that are too light absortive, e.q. double bills, or bills that are too light transmissive, e.q. certain counterfeit bills. IR-type emitters and sensors are used so that the bill cache controls are insensitive to stray ambient light, i.e., light in the visible spectrum.

The outer optical sensors 174, 175 are used as part of a means to count bills dispensed as change. During operation in the pay-out mode, each bill dispensed to the opening 18 is detected by the outer optical sensing means. The bill belts can be controlled to dispense each bill entirely past the entrance rollers and past the first sensing means and into the money tray 16; and the outer sensing means can detect when each bill has been dispensed from the opening to provide data to a counter for counting each bill so dispensed.

Alternatively, the bill belts can be controlled in the pay-out mode to feed a bill halfway through the opening so that the bill remains between the entrance rollers blocking the outer sensor until the bill is taken from the opening by the customer. The outer sensor can detect when a bill present between the entrance rollers is taken by a customer and can produce data fed to a counter for counting each bill taken by the customer. The bill belts can be controlled in the pay-out mode to feed only the last bill paid as change halfway through the opening 18. The computer disarms the bill belts after the last bill is payed out as change, and remains so until a subsequent arming command from a Total key.

The inner optical sensors 176, 177 can detect whether or not a bill that is tendered into the opening is actually drawn into the housing. The pay-in cycle is activated when the outer optical sensors 174, 175 indicate that a bill is in the opening. If the tendered bill is not detected by the inner optical sensors 176, 177 within the 0.5 second time period counted by the computer, a command is issued for halting the belts. This restricts the forward travel of the belts when they are "teased", thus valuable storage space is saved.

Either the outer or the inner sensing means also can be used to detect the thickness of a tendered bill in order to validate a pay-in transaction. Each IR sensor can indicate the opacity of a tendered bill between the emitter and the sensor. A valid bill has a predetermined opacity. If more than one bill is between the emitter and sensor, or if the thickness of the tendered bill is not the required thickness, or if the tendered bill is otherwise not genuine, the light transmissivity detected by the optical sensor either can be too high or too low, compared to a required range of opacity for a genuine bill.

Third optical sensors are provided by an infra-red sensor 178 and emitter 179 positioned to the rear of the bill viewing path 142 immediately in front of the first guide roller 136. These sensing means can be optionally used to detect the leading edge of a bill drawn into the bill cache for generating data to be fed to the data processor to issue a command for stopping the pay-in feed operation.

COIN CACHE

Figure 6:
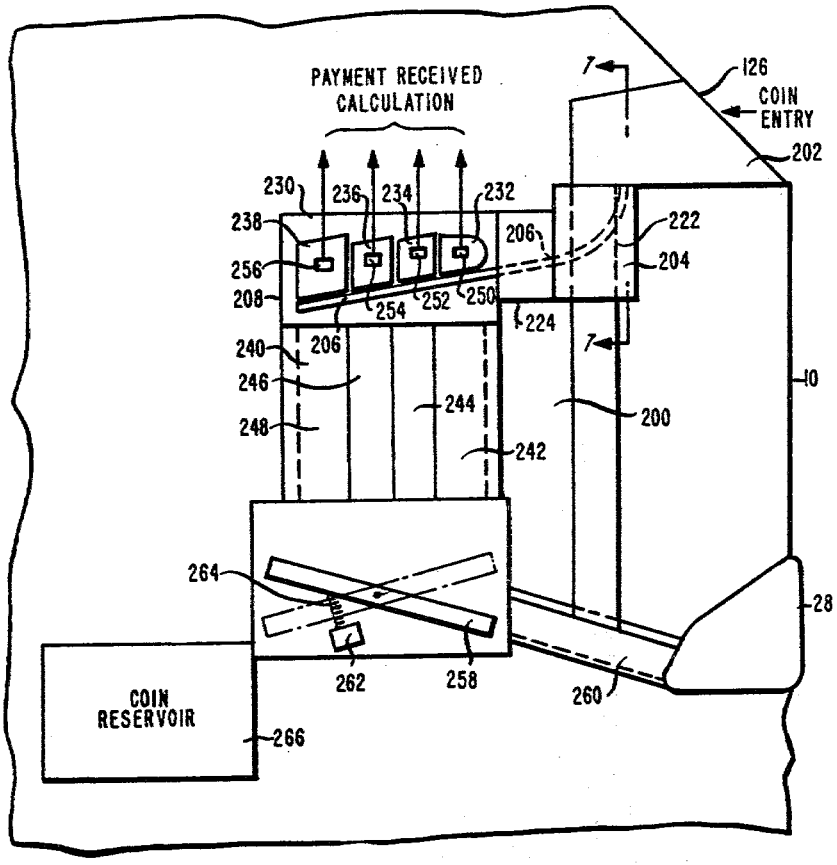
FIGS. 6 and 7 show two views of the coin changer used in connection with the present invention.
Figure 7:
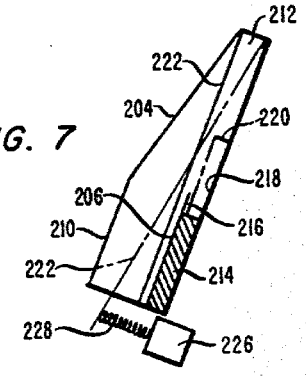
Figure 8:
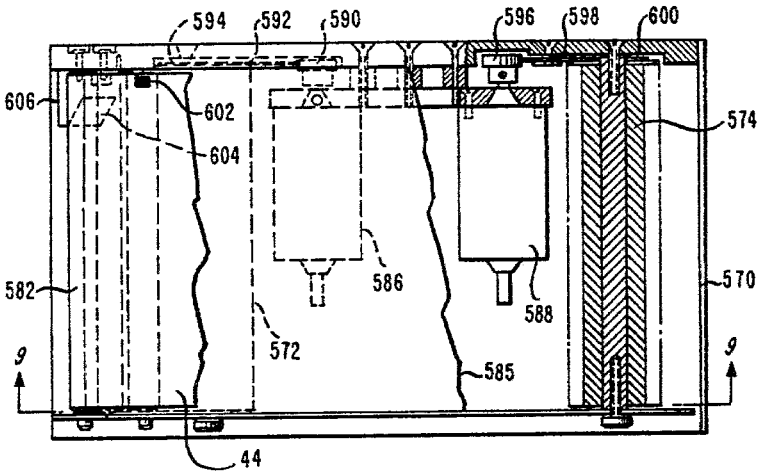
FIGS. 8 and 9 show top and side views respectively of one embodiment of a prompting device forming a part of the invention of the co-pending applications.
Figure 9:
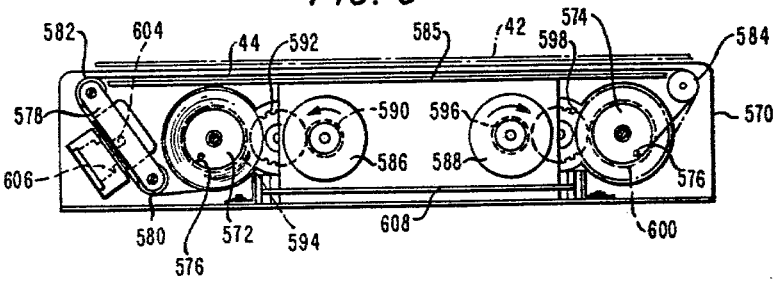

FIGS. 6 and 7 show a coin receiver dispenser and storing device 200 located in the interior of the housing 10. The coin changer includes a coin sorter and a coin dispenser. Coins deposited into the single coin slot 26 on the front of the housing 10 travel through a first coin guide 502 for funneling the coins, one at a time, into the top of a second coin guide 504 having a sloping internal track 506 for guiding each coin to a coin sorter 508.

Separate optical sensors, or mechanical or electrical switches at the coin sorting openings in the coin sorter can detect when a particular coin passes into each opening of the sorter for issuing signals to the computer indicating the denominations of coins received. The computer, in turn, can provide for calculating the payment received. For example, a first optical sensor 550 is located adjacent the dime-sorting opening 532, a second optical sensor 552 is located adjacent the penny-sorting opening 534, a third optical sensor 554 is located adjacent the nickel-sorting opening 536, and a fourth optical sensor 556 is disposed adjacent the quarter-sorting opening 538. The optical signal emitted and sensed by each sensor is blocked when a coin either passes through the opening or bypasses the opening where each sensor is located.

The change dispenser is conventional in structure and operation, and an example of a coin dispenser which can be used for the purpose of the present invention is Model 2941 Change Dispenser manufactured by SCI Systems, Inc. of Huntsville, Alabama. Coins dispensed as change by the coin dispenser generate data for the computer to provide a running total of coins available in each column dispenser.

The data processing system also provides for detecting when a coin overflow condition is imminent. When a coin overflow condition is imminent in a given column, the solenoid 562 is energized to pivot the coin diverter 558 in the position shown in phantom lines in FIG. 6 for funneling any further coins that column into a coin reservoir 266. After the coin diverter has diverted the coin to the coin reservoir, the solenoid is de-energized to return the coin diverter to its normal position, under the action of the coil spring 264. Coins of a particular denomination are funneled into the coin reservoir only when an overflow condition for that particular denomination is sensed. If coins are removed from a coin column in the coin dispenser, appropriate data related to the amount of coins removed is supplied to the data processor.

ORGANIZATION OF ELECTRONIC HARDWARE

Figure 10:
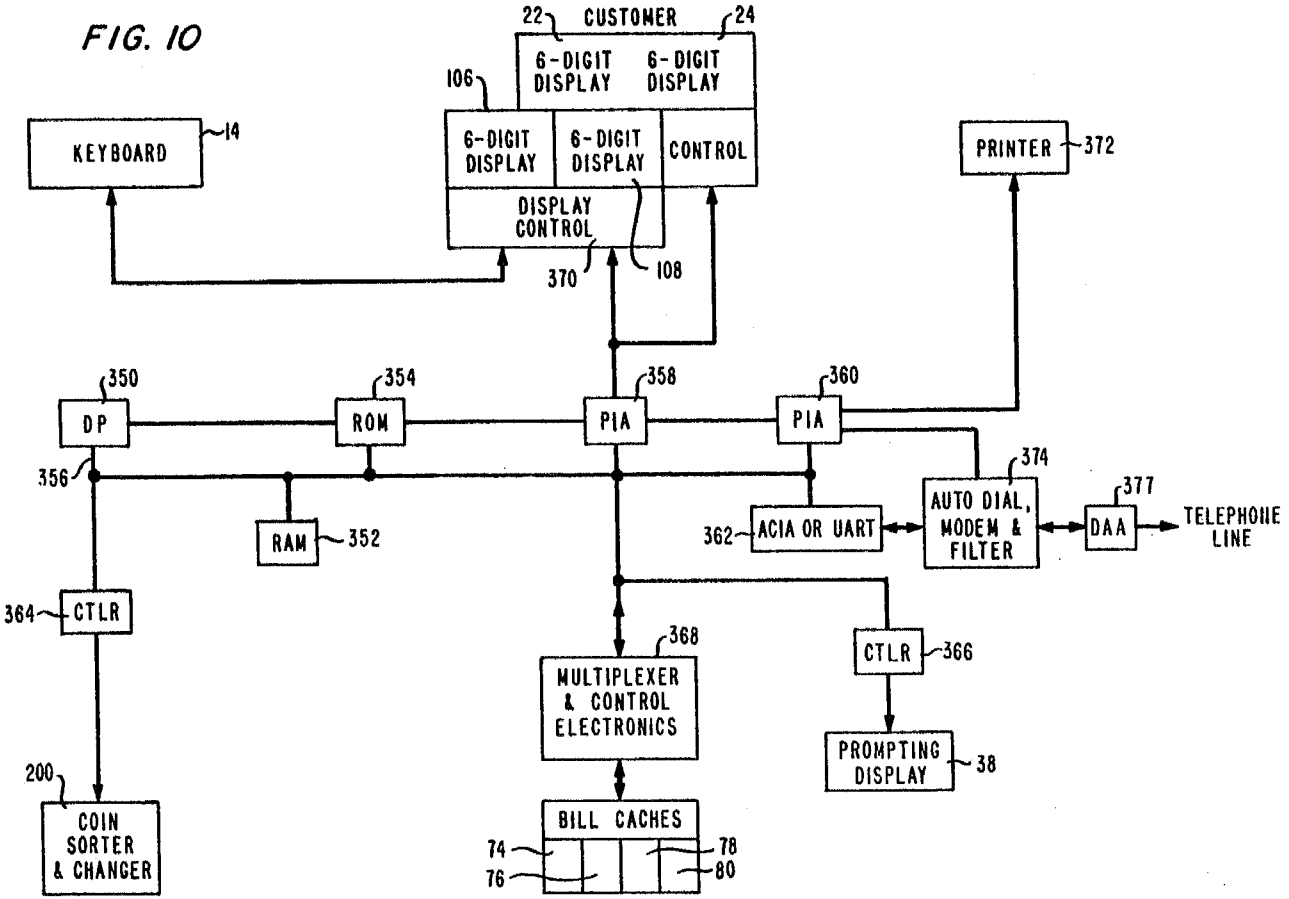
FIG. 10 shows a block diagram of the present invention as part of a larger point of sale terminal system.

With reference to FIG. 10 there will now be generally described the overall organization of the electronic hardware contained in housing 10.

The Computer comprises a data processor 350 and a memory, preferably including a RAM 352 and a ROM 354. It is preferable to split the memory into a random access portion and a read-only portion so that software and system constants can be stored in the read-only memory portion and thereby prevent temporary loss thereof in the event of a power failure or the like. Suitable capacity for RAM 352 is 16K bytes (each byte being 8 bits). Suitable capacity for ROM 354 is 24K bytes.

In the illustrated embodiment of the present invention, data processor 350, RAM 352, and ROM 354 and a battery backed RAM. These products are commercially manufactured by Motorala and others under the designations MC6800 Microprocessing Unit, MCM 4027 Random Access Memory, and Intel Read-Only Memory, (2708 EPROM) respectively. Motorola has published a series of manuals describing the construction and operation of, and various uses for, the MC6800 Micorprocessing Unit and various companion products including the MCM 4027 Random Access Memory, and MC 6820 Peripheral Interface Adapter (PIA), the MCM6830 Read-Only Memory, and an MC6850 Asynchronous communication Interface Adapter (ACIA). These manuals include an M6800 EXORciser User's Guide, an M6800 Microprocessor Programming Manual, an M6800 Microprocessor Applications Manual, and various M6800 Microprocessor Family of Parts date sheets. These materials are incorporated by reference into this specification as fully as if they were reproduced here.

It will be appreciated by those skilled in the art that the above-described specific products are exemplary of various commercially available products suitable for use in the point of sale system. The MC6800 microprocessor incorporates particular structure for performing certain functions such as input/output functions that are performed by different structures in other commercially available systems which are suitable for use with the present invention.

A unibus is depicted in FIG. 10 as bus 356 coupling data processor 350 to RAM 352, ROM 354, a PIA 358, a PIA 360, an ACIA 362, a controller 364, a controller 366, and a multiplexer and control electronics 368. Each PIA is fully described in the above-identified Motoroia manuals. Similarly, the ACIA is fully described therein. PIA 358 provides an interface between data processor 350 and a controller 370 for the keyboard and the displays, and PIA 360 provides an interface for the printer 372 and a modem 374. Modem 374 is coupled to DAA 377 so that data stored in RAM 352 can be transmitted via a telephone line to a central data processing system. Multiplexer 368 is a specially designed interfacing device.

MULTIPLEXER

Figure 11:
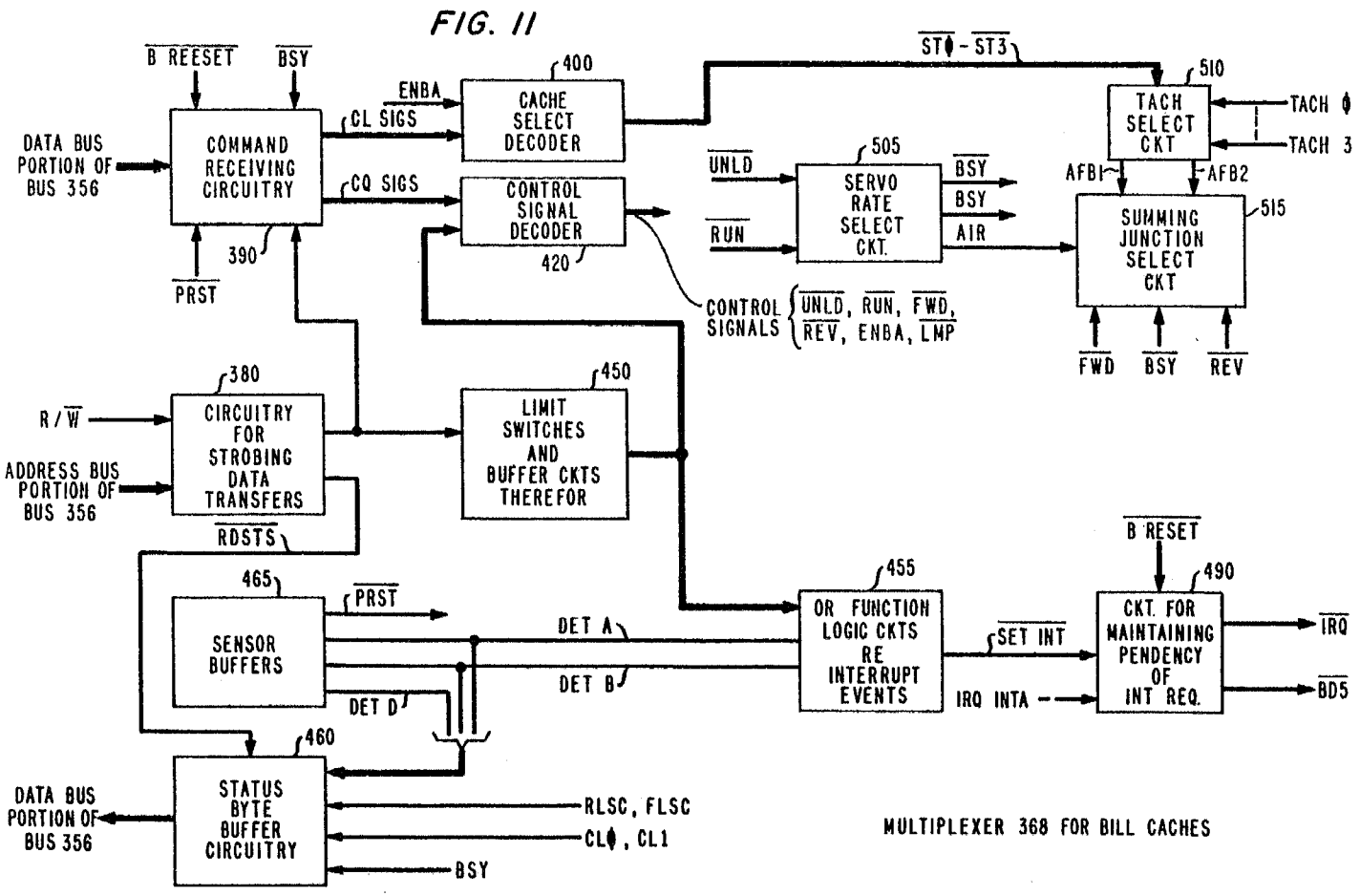
FIG. 11 shows a block diagram of the multiplexer shown in FIG. 10.

With reference to FIG. 11, multiplexer 368 is connected to bus 356 to receive addresses and commands from date processor 350 and to feed status data back to data processor 350. The address bus portion of bus 356 comprises 16 wires (not individually shown). More than 64K separate addresses can be instantaneously defined by the parallel-bybit signals carried by the address bus, each address is symbolized by a four place hexidecimal number. For example, in the specifically described embodiment, the address of multiplexer 368 has been arbitrarily chosen as the four place hexidecimal number 80E1. Numbers that expressed in hexidecimal formm are indicated by the letter H or a "$" preceding the number.

The addresses applied to bus 356 by data processor 350 are in accordance with a positive logic format subject to three-state control (TSC). That is, each of the 16 address bus wires is connected to the output of one of 16 three-state buffer circuits within data processor 350.

Whenever data processor 350 applies an address to the address bus, it simultaneously controls the value of an R/$\overline{W}$ signal to designate whether a read or write operation is involved.

Multiplexer 368 has circuitry for strobing data transfers, herein referred to as strobing circuitry 380 with positive logic format.

Figure 12:
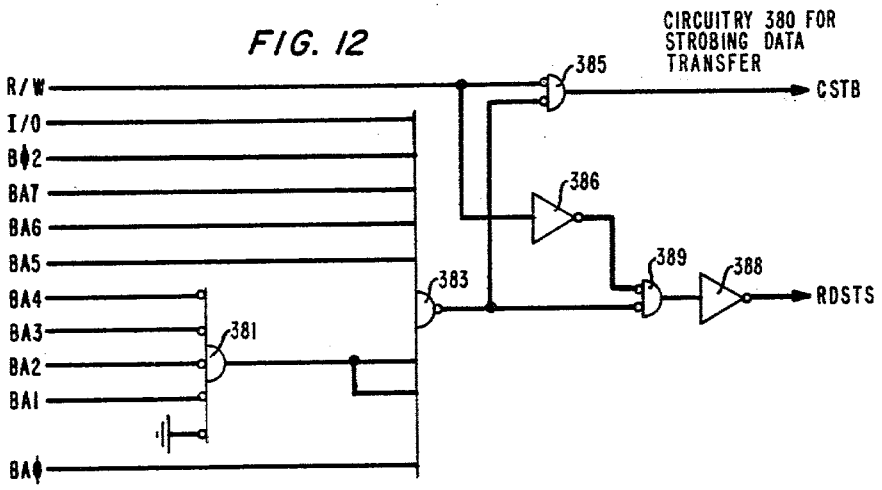
FIGS. 12–23 show details of the electrical circuitry shown in FIG. 11 above.

A suitable arrangement of digital circuits which is used in the illustrated embodiment for producing the above-mentioned strobing signals is shown in detail in FIG. 12. A NOR gate 381 (such as one-half of type 74LS260) receives five input signals and produces an output signal that is high (at or near +V1) only when each of its five input signals is low (at or near ground). A NAND gate 383, (such as type 74LS30) receives eight input signals and produces an output signal that is low only when each of its eight input signals is high. The above-mentioned input signals include signals identified as BA0 through BA7, (which are the eight least significant bits of the address carried by the address bus), and an I/O signal produced by decoding circuitry. The I/O signal equals 1 when the eight most significant bits of the address define the number H80. With gates 381 and 383 being connected as shown, the output signal produced by gate 383 is low whenever the address H80E1 is carried by the address bus.

NOR gate 385 (¼ of type 74LS02) received two input dignals and its output is the CSTB signal-which in when high the computer issues a command to multiplexer 368.

The R/$\overline{W}$ signal is inverted by an inverter 386 whose output signal is applied as one of two input signals to a NOR gate 387. The other input signal for NOR gate 387 is received from NAND gate 383. The output signal produced by NOR gate 387 is inverted by an inverter 388 to produce the $\overline{RDSTS}$ signal. Owing to the foregoing arrangement, the $\overline{RDSTS}$ signal equals 0 whenever data processor 350 addresses multiplexer 368 for a read operation to read status data.

Figure 15:
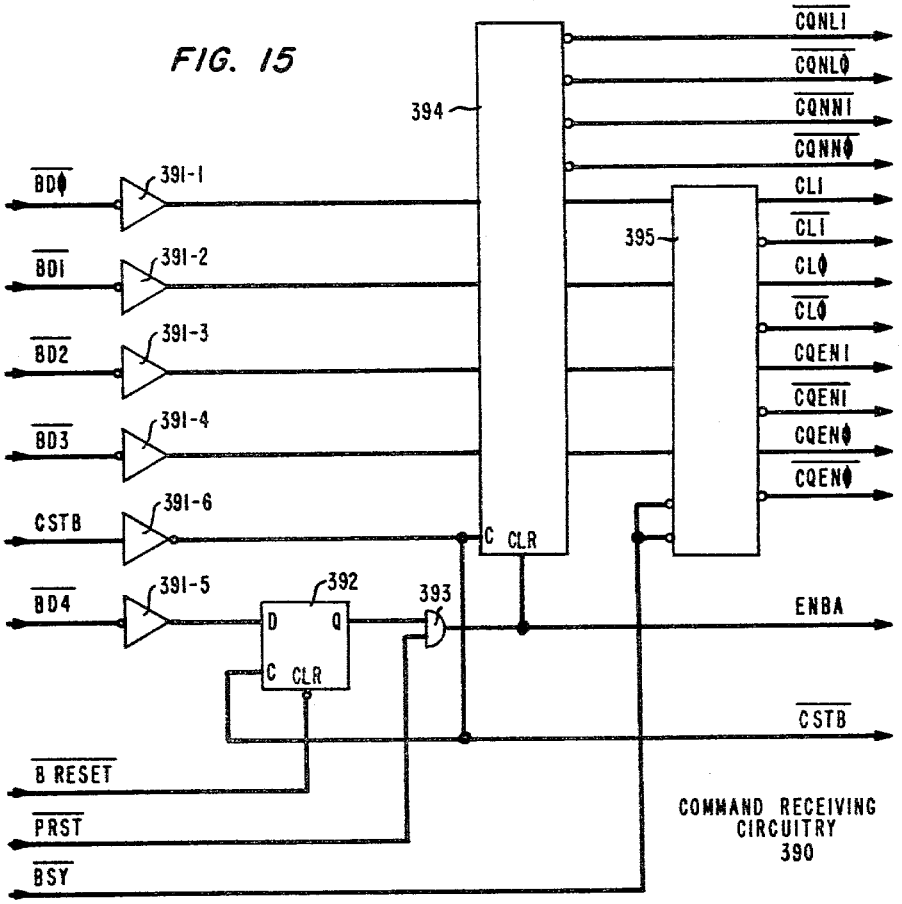

With reference again to FIG. 11, multiplexer 368 has command receiving circuitry 390 that is strobed by the CSTB signal. A suitable arrangement of digital circuitry which is used in the illustrated embodiment for receiving commands is shown in detail in FIG. 15. Each command issued by data processor 350 to multiplexer 368 is carried by a portion of bus 356. The data bus portion comprises eight bidirectional lines for carrying signals identified as $\overline{BD0}$ through $\overline{BD7}$ respectively. Of these, the signals BDO through BD4 are involved in defining the commands issued to multiplexer 368.

Table 1 below gives the coding for the commands issued to multiplexer 368.

TABLE 1

| BD4 | BD3 | BD2 | BD1 | BD0 | |
|---|---|---|---|---|---|
| X | X | X | H | H | select belt 74 ($1) as scanned one |
| X | X | X | H | L | select belt 76 ($5) as scanned one |
| X | X | X | L | H | select belt 78 ($10/20) as scanned one |
| X | X | X | L | L | select belt 80 (coupon) as scanned one |
| X | H | H | X | X | stop |
| X | H | L | X | X | forward |
| X | L | H | X | X | reverse |
| X | L | L | X | X | unload |
| L | X | X | X | X | arm |

TABLE 1-continued

| BD4 | BD3 | BD2 | BD1 | BD0 | |
|---|---|---|---|---|---|
| H | X | X | X | X | disarm |

Command receiving circuitry 300 includes five inverters 391-1 through 391-5 for inverting the five parallel signals defining the commands issued to multiplexer 368. The signal produced by inverter 391-5 is applied to the D input of a D-type flip flop 392 (one quarter of 74LS74). An iverter 391-6 responsive to the CSTB signal has its output connected to the clock input of flip flop 392. Accordingly, when data processor 350 issues ann arming command to multiplexer 368, flip flop 392 is triggered into its set state, and when data processor issues a disarming command to multiplexer 368, flip flop 392 is triggered into its reset state. Flip flop 392 can also be cleared by the B RESET signal by bus 356.

An AND gate 393 is responsive to the output signal produced by flip flop 392 and to a $\overline{PRST}$ signal. Normally high and is low only for a brief interval such as approximately 100 milliseconds following initial application of power to the electronic hardware. The signal produced by AND gate 393 is the ENBA signal which is a mode control signal.

The ENBA signal is applied to the clear input of a register 394 (type 74LS175) comprising four D-type flip flops (not individually shown). So long as the ENBA signal equals O, thereby defining the disabled mode, each of the flip flops in register 394 is held in the reset state. With the ENBA signal equaling 1, register 394 is responsive to triggering by the CSTB signal, with each such trigger causing the register to be loaded with a command issued by data processor 350 for controlling a selected one of the bill caches 74, 76, 78, and 80.

Command receiving curcuitry 390 further includes a copy/latch register 395 (type 7475) comprising four latch circuits (not individually shown). Copy/latch register 395 receives a $\overline{BSY}$ signal which equals 0 only during intervals of time during which an electrical energization pulse is being applied to cause the scanned one of the bill belts to be driven. With the $\overline{BSY}$ signal equaling 0, copy/latch register 395 exhibits memory. During the intervals in which the $\overline{BSY}$ signal equals 1, each of the four latch circuits in copy/latch register 395 copies the output signal of a corresponding one of the four flip flops in register 394.

Figure 17:
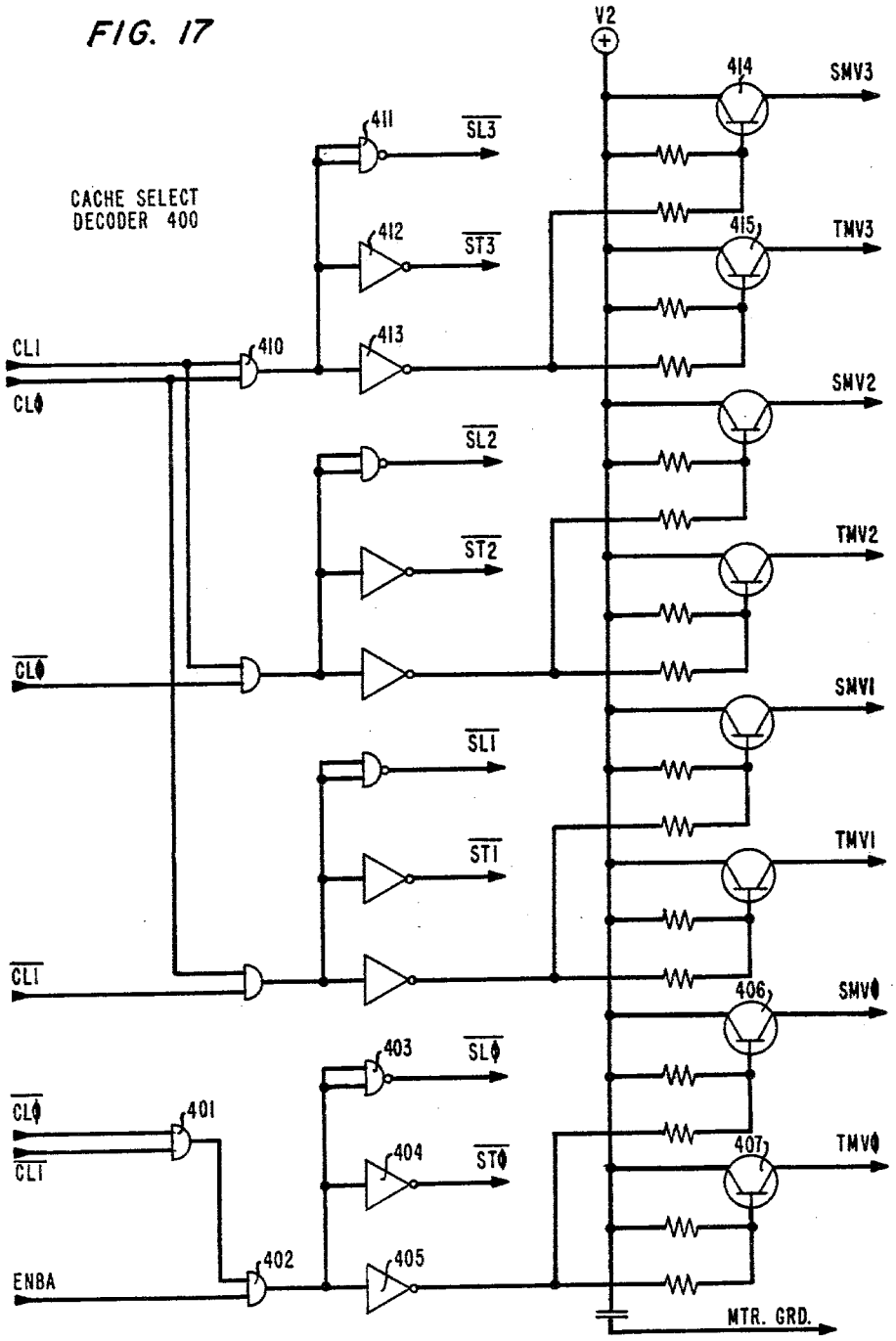

With reference again to FIG. 11, multiplexer 368 includes a belt select decoder 400 for decoding the bill belt identifying portion of each command issued to multiplexer 368. A suitable arrangement of digital circuitry which is used in the illustrated embodiment for effecting such decoding is shown in detail in FIG. 17. An AND gate 401 receives the $\overline{CLO}$ and $\overline{CLI}$ signals and produces an output signal that is applied to an AND gate 402. The ENBA signal is also applied to AND gate 402. The output signal produced by AND gate 402 is applied to three inverters 403, 404, and 405. Inverters 403 and 404 produce output signals $\overline{SLO}$ and $\overline{STO}$, respectively. Inverter 405 has its output resistively connected to the base electrodes of power transistors 406 and 407. When power transistor 406 is switched on, it connects a source of power +V2, suitably +12 volts unregulated, to one terminal SMVO of the series-connected supply reel drive motors in bill cache 74. At the same time that transistor 406 is switched on, power transistor 407 is switched on to connect the source of power to one terminal TMVO of the take-up drive motor in bill cache 74.

During intervals in which the disabled mode is being defined by the ENBA signal, copy/latch register 395 (FIG. 15) identifies bill belt 74. Inasmuch as AND gate 402 is responsive to the ENBA signal, however, neither power transistor 406 nor power transistor 407 is switched on in the disabled mode.

Decoder 400 further includes three decoding arrangements that are structurally identical to each other and are substantially similar to the above-described decoding arrangement concerning bill belt 74. The only difference in structure arises because there is no need for the decoding arrangements for bill belts 76, 78, and 80 to respond to the ENBA signal. Inasmuch as these three decoding arrangements are structurally identical to each other, only one of them is described. An AND gate 410 receives the CLO and CLI signals and produces an output signal that is applied to inverters 411, 412, and 413. Inverters 411 and 412 produce output signals $\overline{SL3}$ and $\overline{ST3}$ respectively. Inventer 413 has its output resistively connected to the base electrodes of power transistors 414 and 415 that control the switching of power to the supply and take-up drive motors in bill cache 80 in the same manner as power transistors 406 and 407 do so for bill belt 74.

Figure 16:
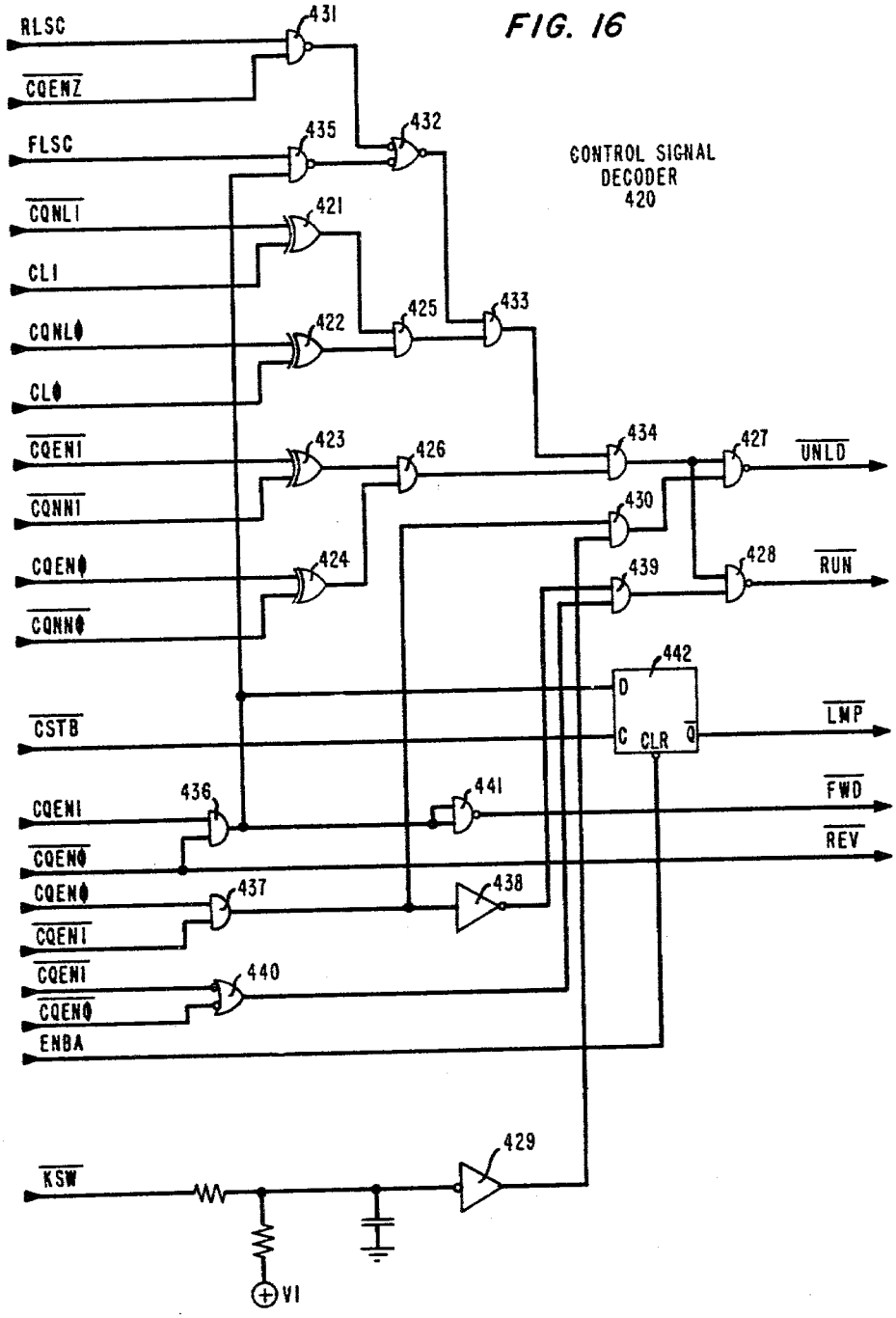

Six of the gates shown in FIG. 16 (which shows the decoder 402) are involved in detecting whether the existing command equals the next command. These are exclusive-OR gates 421, 422, 423, and 424 and AND gates 425 and 426. In circumstances in which the existing command equals the next command, the output signals produced by AND gates 425 and 426 each equals 0, two of the control signals produced by decoder 420, namely, $\overline{UNLD}$ signal produced by a NAND gate 428, each equals 1.

The $\overline{UNLD}$ signal is involved in controlling a high-speed dump operation by which a store owner or manager empties a bill belt. As a security measure, housing 10 has a key-controlled lock (not shown) used for controlling a $\overline{KSW}$ signal. An inverter 429 receives the $\overline{KSW}$ signal and produces an output signal that is applied to an AND gate 430. Owing to the connection as shown between AND gate 430 and NAND gate 427, the $\overline{UNLD}$ signal cannot equal 0 unless the $\overline{KSW}$ equals 0.

When the storage reel has reached its maximum diameter or the supply reels have reached their maximum diameter, NAND gate 431 receives an RLSC signal produced by circuitry to be described with reference to FIG. 19 and that receives the CQENO signal produced by the circuitry described above with reference to FIG. 15. In circumstances in which the existing command calls for a bill belt to unload at a time while the RLSC signal equals 0. In such circumstances, AND gates 432, 433, and 434, which are connected in tandem as shown between NAND gate 431 and NAND gate 427, cause the $\overline{UNLD}$ signal to equal 1. Under the same conditions NAND gate 435 receives a FLSC signal also produced by the circuitry shown in FIG. 19, and receives the output signal produced by an AND gate 436. Consider now circumstances in which the existing command calls for a bill belt to move forward a a time while the FLSC signal equals 1. In such circumstances, the CQEN1 and the $\overline{CQEN0}$ signals each equals 1, whereby the output signal produced by AND gate 436 also equals 1. Owing to the connection as shown of the tandem gates between AND gate 436 and NAND gate 428, the $\overline{RUN}$ signal equals 1 in these circumstances.

Figure 19:
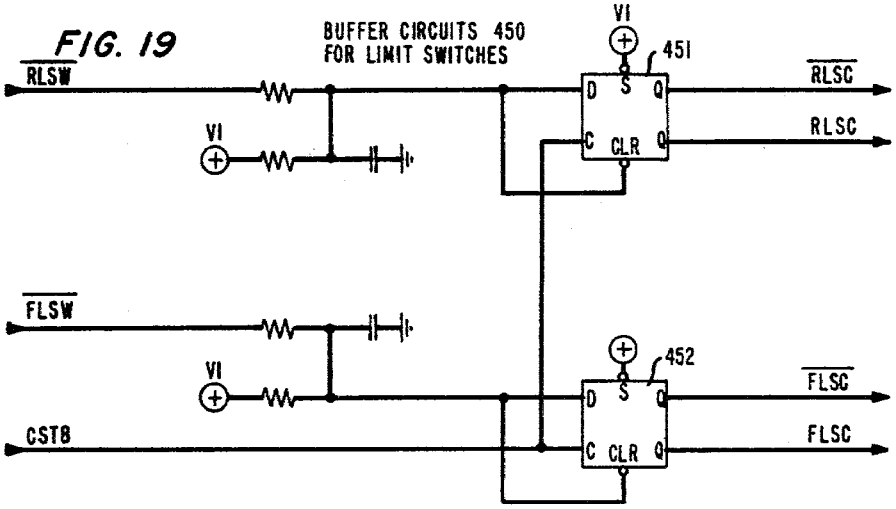

A suitable arrangement of such buffer circuits 450 used in the illustrated embodiment is shown in detail in FIG. 19. As shown, two D-type flip flops 451 and 452 are included in these buffer circuits. When the supply reels of the scanned bill belts have reached maximum diameter, its reverse limit switch causes an $\overline{RLSW}$ signal to equal 0. This signal is coupled through an RC delay circuit to the clear input of flip flop 451. Accordingly, while the supply reels are at maximum diameter, flip flop 451 is in its reset state causing an RLSC signal to equal 1 and an $\overline{RLSC}$ signal to equal 0. The flip flop is triggered into its set state when a command issues to multiplexer 368, thereby causing the CSTB signal to define a positive pulse, at a time while the RLSW signal equals 1 thereby causing the CSTB signal to define a positive pulse, at a time while the $\overline{RLSW}$ signal equals 1 thereby indicating that the supply reels are not at maximum diameter.

Figure 20:
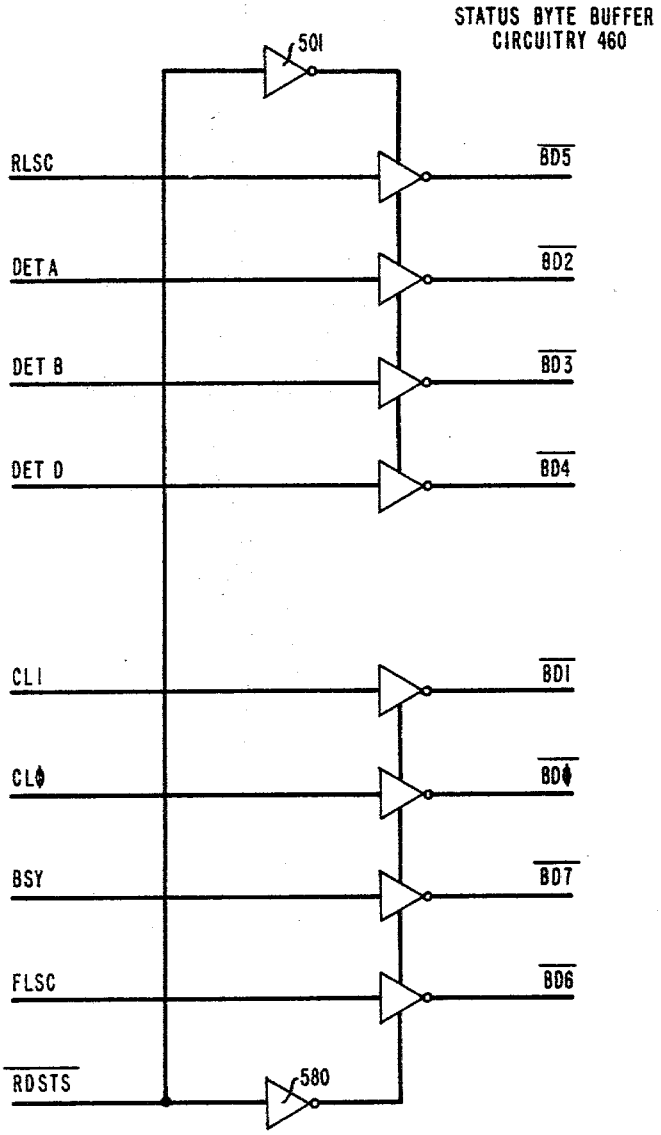

Similarly, when the take-up reel of the scanned bill belt has reached maximum diameter, its forward limit switch causes an $\overline{FLSW}$ signal to equal 0. This signal is coupled through an RC delay circuit to the clear input of flip flop 452. Accordingly, while the take-up reel is at maximum diameter, flip flop 452 is in its reset state, causing the FLSC signal to equal 1 and the $\overline{FLSC}$ signal to equal 0. Flip flop 452 is triggered into its Set state when a command issues to multiplexer 368, thereby causing the CSTB signal to define a positive pulse, at a time while the $\overline{FLSW}$ signal equals 1 thereby indicating that the supply reels are not at maximum diameter. The above-described four output signals of buffer circuits 450 are distributed to control signal decoder 420, to OR function circuitry 455 (FIGS. 11 and 13), and to status byte buffer circuitry 460 (FIGS. 11 and 20).

Figure 18:
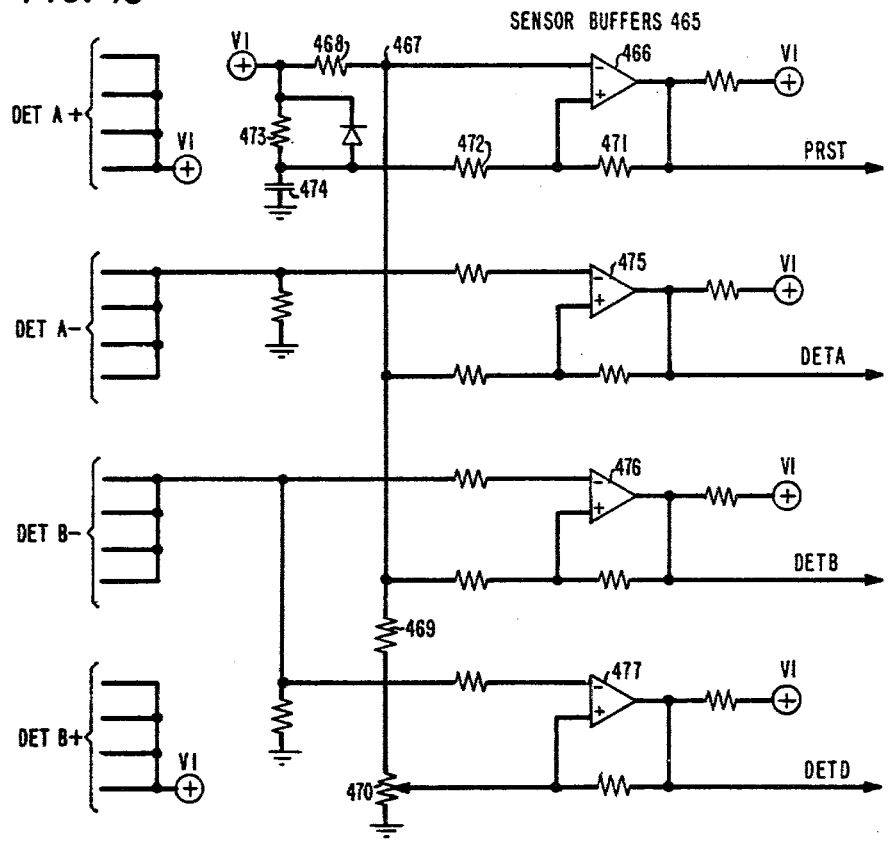

A suitable arrangement of such sensor buffers used is illustrated. The principal function of the circuitry of FIG. 18 relates to sensor buffering, the circuitry also provides for producing the $\overline{PRST}$ signal which is used to initialize the states of various bistable circuits incident to the turning on of power. In this connection, the sensor buffer 465 of FIG. 18 includes a comparator circuit 466 (type 6M339) whose output signal is the $\overline{PRST}$ signal. The inverting input of comparator circuit 466 is connected to a node 467 of a resistor divider network comprising resistors 468 and 469 and potentiometer 470. The non-inverting input of comparator circuit 466 is connected to a positive feedback arrangement of resistors 471 and 472. When power is turned on, the voltage level at node 467 of the resistor divider network rapidly changes to its steady state value. On the other hand, a delay circuit comprising a resistor 473 and a capacitor 474 supplies a relatively slowly changing voltage to resistor 472. For approximately the first 100 milliseconds after power is applied, the voltage at node 467 exceeds the voltage applied to resistor 472 with the result that the $\overline{PRST}$ signal equals 0 for this brief interval. At the end of this brief interval, which ends as soon as the voltage to resistor 472 exceeds the voltage at node 467, the $\overline{PRST}$ signal changes to the 1 value. The positive feedback arrangement causes the pulse defined by the PRST signal to have sharp rise and fall times.

Identical comparator circuits 475 and 476 are likewise connected to positive feedback arrangements for causing the output signals they produce, identified as DET A, and DET B, to have sharp rise and fall times.

The non-inverting inputs of comparator circuits 475 and 476 are coupled by resistors of their positive feedback arrangements to the node 467. The inverting input of comparator circuit 475 is resistively coupled to the terminal identified as DET A−. It will be recalled from the description of the outer IR sensors, set forth in the section directed to the construction of a bill cache, that the emitter electrodes of the four emitter electrodes are commonly connected to this terminal.

While any one of the four signals $\overline{SL0}$ through $\overline{SL3}$ (FIG. 17) equals 0, the signal applied to this terminal normally is more positive than the steady state voltage at node 467. If a bill is present in the scanned bill belt between its IR emitter 175 and its sensor 174, this signal becomes less positive, with the result that the output signal DET A becomes equal to 1. In like manner, the inverting input of comparator circuit 476 is resistively coupled to receive a signal applied to the DET B− terminal. This signal is controlled by the inner IR sensor of the scanned bill belt to be normally more positive than the steady state voltage at node 467. If a bill is present in the scanned bill belt, between its IR emitter 177 and its sensor 176, this signal becomes less positive with the result that the output signal DET B becomes equal to 1. Another comparator circuit 477 has a single positive feedback resistor and has its non-inverting input connected to the tap of potentiometer 470. The inverting input of comparator circuit 477 is resistively coupled to the DET B− terminal. Owing to this arrangement, whenever the inner sensor of the scanned bill cache detects a double bill, the DET D signal becomes equal to 1.

The logic circuitry 455 cooperates with other circuitry described below with reference to FIG. 14 to generate an interrupt request supplied to data processor 350. The DET A signal is inverted by an inverter 480 whose output signal is applied to a delay circuit generally identified at 481. The output signal of delay circuit 481 is inverted by inverter 482. One input of exclusive OR gate 483 is directly connected to the output signal of inverter 482, and the other input is coupled through delay circuit 484 to receive the same signal. Thus, whenever the DET A signal changes from 0 to 1 or changes from 1 to 0, the output signal produced by gate 483 is positive.

NOR gate 485 responds to each positive pulse to cause its output signal, $\overline{(SET\ INT)}$ to a negative pulse. Whenever the leading edge or trailing edge of a bill passes the outer sensor of the scanned bill belts, the $\overline{SET\ INT}$ signal will change from its normal 1 to a temporary 0 and then return to its normal 1.

Figure 22:
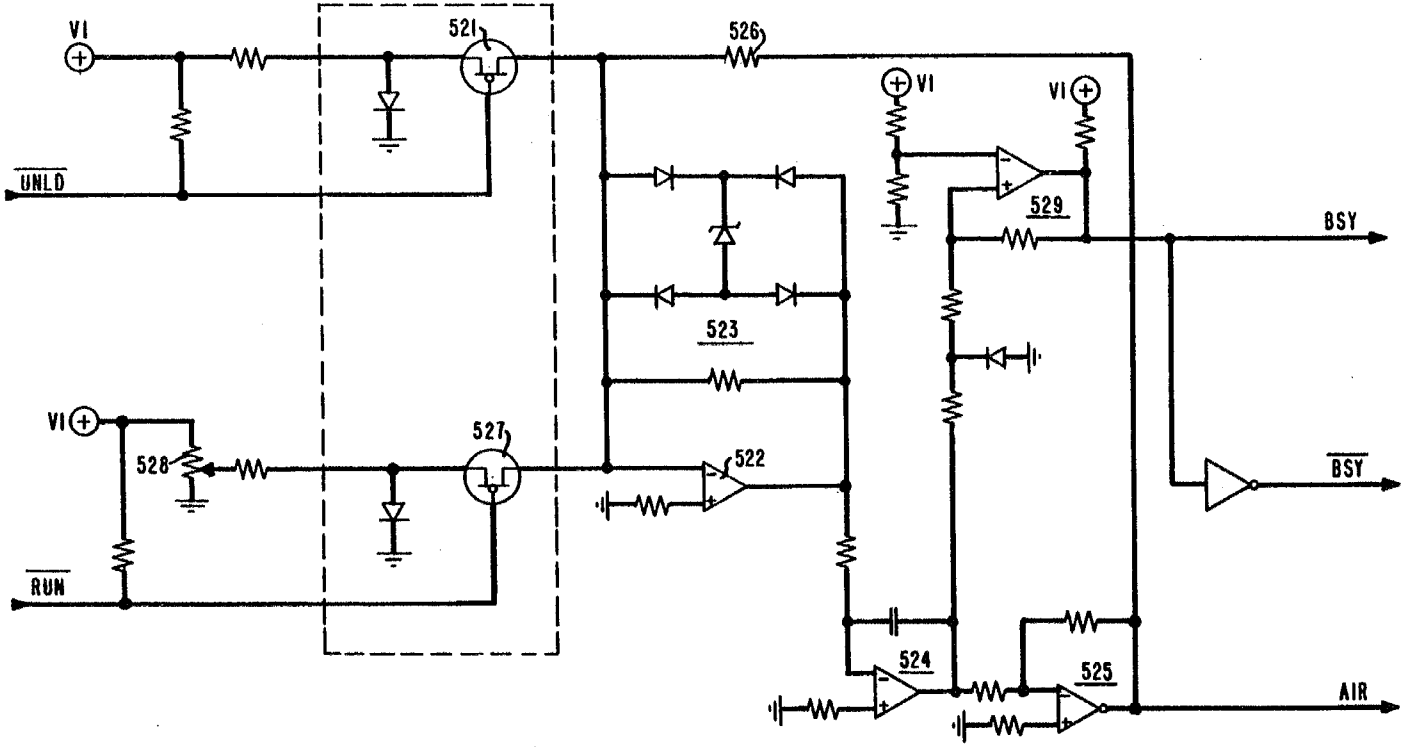

An arrangement structurally identical to the foregoing performs the same function with respect to the inner sensor. Whenever a change from either a 1 or a 0 or from a 0 to a 1 occurs in the DET B signal, a negative going pulse is defined in the $\overline{SET\ INT}$ signal. A BSY signal, produced by circuitry to be described with reference to FIG. 22, is applied to an inverter 486 whose output is coupled through a differentiating circuit generally identified at 487 to NOR gate 485. Whenever the BSY signal changes from 1 to 0, a negative going pulse is defined in the $\overline{SET\ INT}$ signal.

Figure 13:
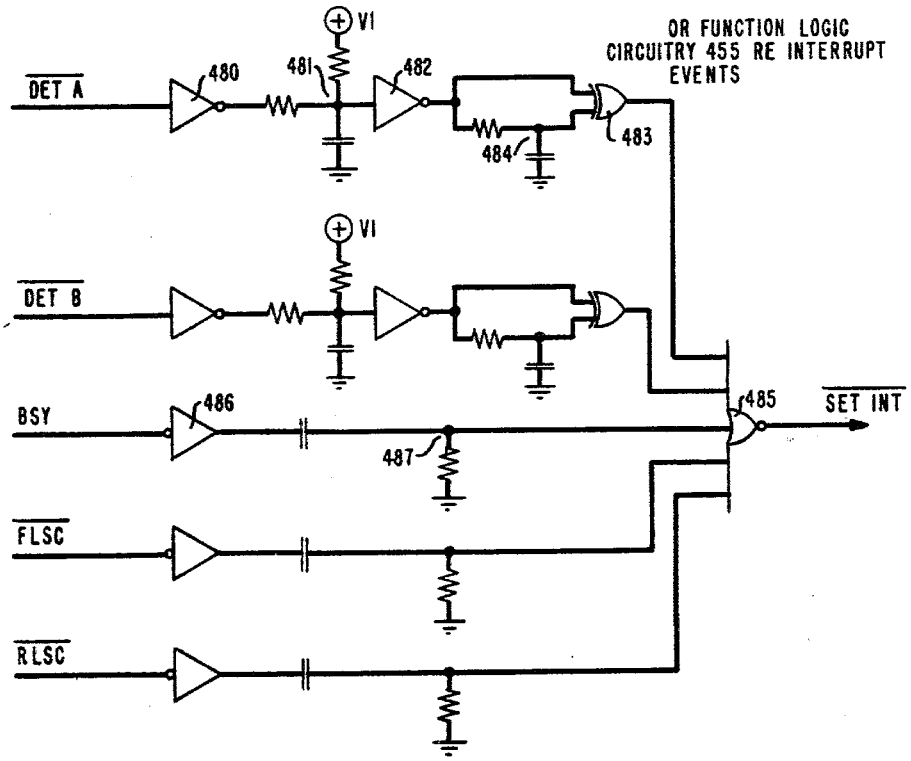

The remaining circuitry shown in FIG. 13 provides separate signal flow paths, each of which is structurally identical to the signal flow path described above with reference to the BSY signal, so that the $\overline{SET\ INT}$ signal is responsive to the $\overline{FLSC}$ and the $\overline{RLSC}$ signals in the same manner that is responsive to the BSY signal.

Circuitry 490 receives several input signals, including the $\overline{SET\ INT}$ signal produced by OR function circuitry 455, and applies two output signals identified as $\overline{IRQ}$ and $\overline{BD5}$ to two of the wires of the bus 356.

Figure 14:
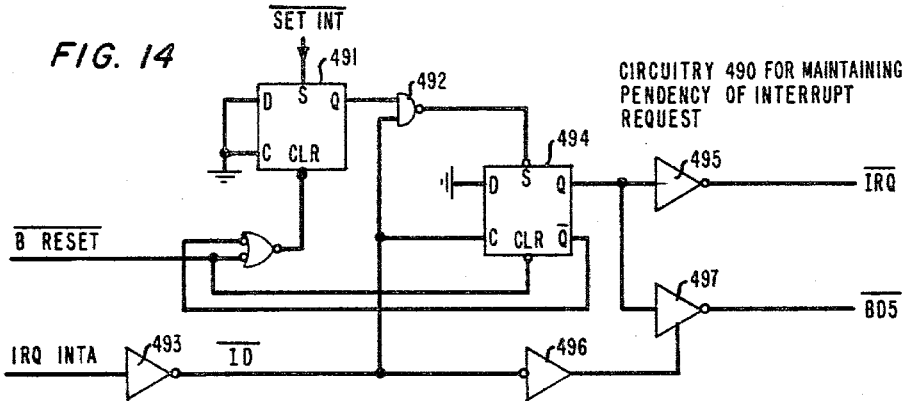

In FIG. 14 a D-type flip flop 491 has a direct set input that receives the $\overline{SET\ INT}$ signal so that each time a negative going pulse is defined in the $\overline{SET\ INT}$ signal, flip flop 491 is placed into its set state. A NAND gate 492 receives the output signal of flip flop 491 and an $\overline{ID}$ signal produced by inverter 493. The input of inverter 493 is connected to one of the wires of bus 356 to receive an IRQ INT a signal. Normally, the latter signal equals 0; it equals 1 only when data processor 350 acknowledges an interrupt request and seeks to ascertain the identity of the peripheral that generated the interrupt request. A D-type flip flop 494 has a direct set input that receives the signal produced by NAND gate 492. Thus, flip flop 494 is placed into its set state each time a negative going pulse is defined in the $\overline{SET\ INT}$ signal. An inverter 495 produces the $\overline{IRQ}$ signal which, while it equals 0, indicates that an interrupt request is pending. When data processor 350 acknowledges the interrupt request by causing a positive going pulse to be defined in the IRQ INT A signal, an inverter 496 enables a three-state gate 497 to drive one of the wires of the data bus portion of bus 356. While so enabled, three-state gate 497 causes the $\overline{BD5}$ signal to equal 0 which serves to inform data processor 350 that it is multiplexer 368 that is generating the interrupt request.

One of the wires of bus 356 carries a $\overline{B\ RESET}$ signal produced by data processor 350. Normally, this signal equals 1. Flip flop 494 has a direct clear input for placing flip flop 494 into its reset state each time the $\overline{B\ RESET}$ signal equals 0. Flip flop 494 is normally triggered into its reset state by the trailing edge of the positive pulse defined in the $\overline{ID}$ signal when data processor 350 seeks to ascertain the identity of the source of the interrupt request.

After data processor 350 has acknowledged an interrupt request and ascertained that it is multiplexer 368 that is the source of the interrupt request, data processor 350 executes a read cycle operation during which status data is entered into data processor 350. In this connection, consider FIG. 20. It will be recalled from the description of FIG. 12 that the $\overline{RDSTS}$ signal equals 0 while data processor 350 causes the $R/\overline{W}$ signal to equal 1 and simultaneously addresses multiplexer 368. The $\overline{RDSTS}$ signal is applied to two inverters 500 and 501 each of which controls a group of four three-state gates. The format of each status byte applied to the data bus portion of bus 356 is evident from FIG. 20.

The remaining circuitry included within multiplexer 368 provides a time-shared servo subsystem for the bill caches. This subsystem includes, as generally shown in FIG. 11, servo rate select circuitry 505, tach select circuitry 510, and summing junction select circuitry 515.

Figure 21:
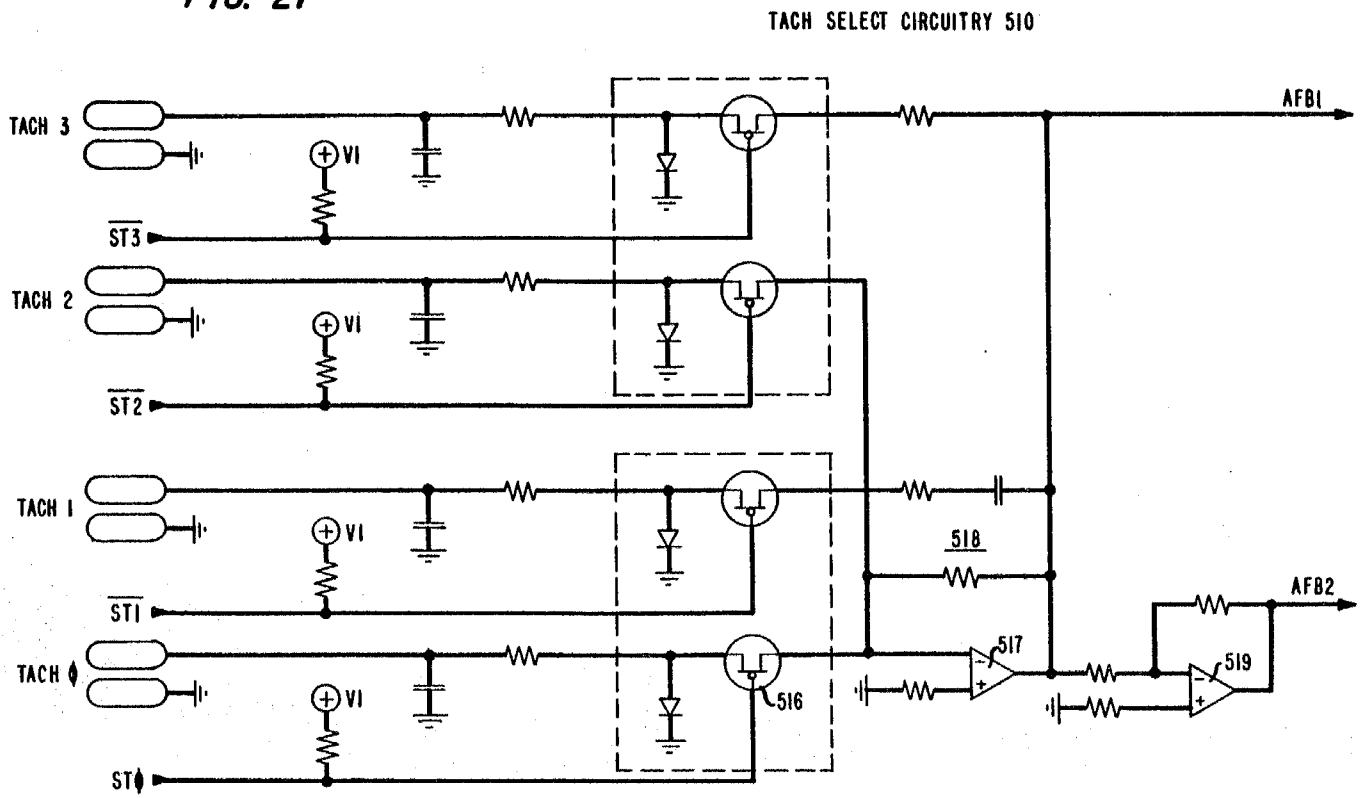

A suitable arrangement of tach select circuitry 510 used in the illustrated embodiment is shown in detail in FIG. 21. It will be recalled from the description of FIG. 4 that each bill belt includes a tachometer. In FIG. 21, the signals produced by the four identical tachometers are identified as tach 0 (the one in bill belt 74), tach 1 (the one in bill belt 76), tach 2 (the one in bill belt 78), and tach 3 (the one in bill belt 80).

When the existing command identifies bill belt 74, the $\overline{STO}$ signal equals 0. An fet 516 receives the $\overline{STO}$ signal at its gate electrode and is switched on while the $\overline{STO}$ signal equals 0. The source and drain electrodes of fet 516 are connected in a series circuit path between tach O and the inverting input of an analog operational amplifier 517 whose output is identified as AFB1 (AFB is an acronym for Analog Feedback). As shown, a conventional servo compensation network 518 is provided to control the gain provided by amplifier 517. An inverting unity gain circuit comprising operational amplifier 519 responds to the AFB1 signal to produce an AFB2 signal which is 180 degrees out of phase from the AFB1 signal.

Three other Fet-switched series circuit paths, each identical in structure to the above-described series circuit path for tach 0, are provided for selectively coupling the tach 1 through tach 3 signals to amplifier 517. These three series circuit paths are controlled by the $\overline{ST1}$ signal, the $\overline{ST2}$, and the $\overline{ST3}$ signal, respectively.

Circuitry 505 shown in FIG. 22 is controlled signals $\overline{UNLD}$ and $\overline{RUN}$, and produces an analog signal AIR (an accronym for Analog Input Rate). The time-shared servo controls the angular velocity of a bill cache drive motor in accordance with a magnitude of the AIR signal. For the high speed dump operation, it is desirable that angular velocity be relatively high; a lower angular velocity is more desirable in connection with either of the pay-in or pay-out modes of the bill caches.

The $\overline{UNLD}$ a signal equals 0 while the security key switch is actuated and the existing command is an unload command. An FET 521 receives the $\overline{UNLD}$ signal at its gate electrode and is switched on while the $\overline{UNLD}$ signal equals 0. The source and drain electrodes of FET 521 are connected in a series circuit path between +V1 and the inverting input of an operational amplifier 522. The gain of amplifier 522 is controlled by a conventional feedback circuit generally indicated at 523. The output signal produced by amplifier 522 is applied to an integrator generally indicated at 524. Suitably, the RC time constant of integrator 524 is between a half a second and one second. The output signal produced by integrator 524 is applied to an inverting, unity gain amplifier generally indicated at 525 whose output signal is the AIR signal. The AIR signal is applied also to one end of a feedback resistor 526, the other end of which is connected to the inverting input of amplifier 522. The $\overline{RUN}$ signal equals 0 while the existing command is either a Forward command or a Reverse (normal speed) command. An FET 527 receives the $\overline{RUN}$ signal at its gate electrode and has its source and drain electrodes connected in a series circuit path between a potentiometer 528 and the inverting input of amplifier 522. FET 527 is switched on only while the $\overline{RUN}$ signal equals 0.

While neither the $\overline{RUN}$ nor the $\overline{UNLD}$ signals equals 0, the AIR signal has a steady state value of 0. When a command is decoded to cause the $\overline{RUN}$ signal to change to 0, FET 527 switches on, the magnitude of the AIR signal increases positively to define a ramp for an interval whose duration is fixed by the time constant of integrator 524. At the end of that interval, the input of integrator 524 will be null. Owing to the memory provided by integrator 524, however, the AIR signal will have a positive value proportional to the setting of potentiometer 528. In a similar manner, when data processor 350 issues a Stop command that is decoded to cause the RUN signal to change back to 1, the AIR signal will define a descending ramp to its steady state value of 0 volts.

The same kind of leading and trailing ramp is defined in response to a cycle of the $\overline{UNLD}$ signal, the only difference from the foregoing residing in the magnitude of the AIR signal.

The output signal produced by inverter 524 is also applied to a circuit generally indicated at 529 that is substantially the same in construction and operation as the circuits described above with reference to FIG. 18. Circuit 529 produces the BSY signal and an inverter 530 responsive thereto produces the $\overline{BSY}$ signal. The BSY and $\overline{BSY}$ signals provide status information as to whether the time shared servo is energizing a drive motor.

Figure 23:
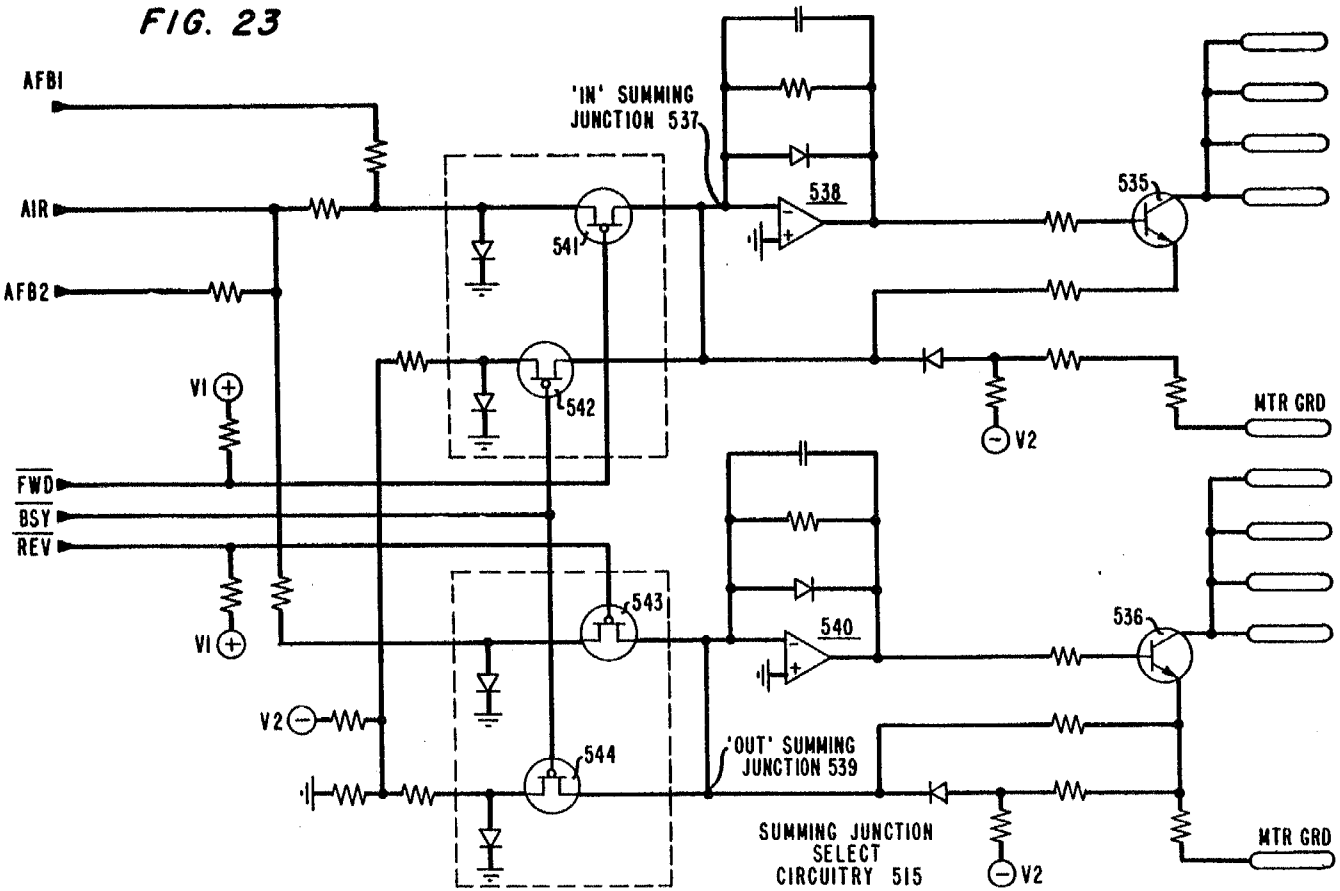
Figure 24:
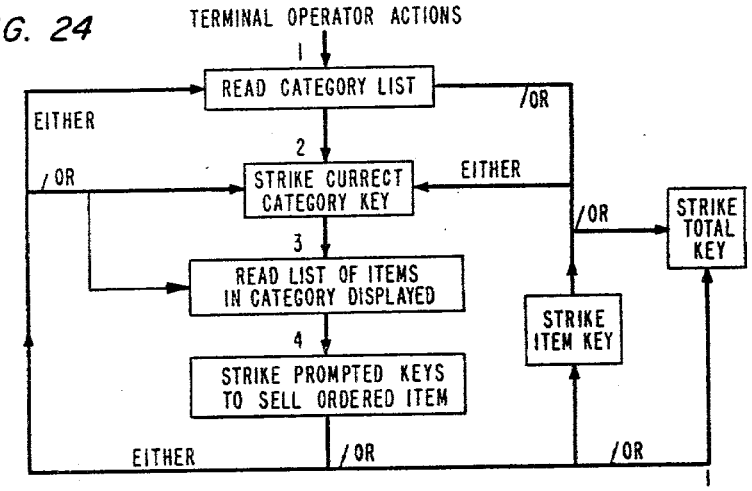
FIG. 24 shows a block diagram of the method steps used by an operator in operating the prompting device which can be used in conjunction with the present invention.
Figure 25:
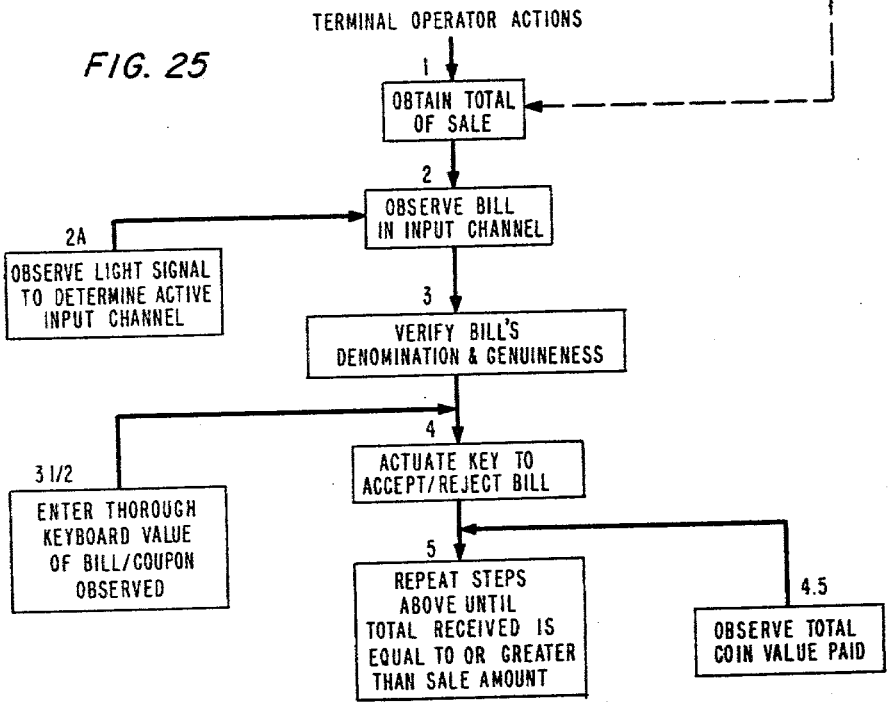
FIG. 25 shows a block diagram of the method steps used by the operator in actuating the present invention during a sale.

A suitable arrangement of summing junction select circuitry 515 used in the illustrated embodiment is shown in detail in FIG. 23. During a pay-in mode of operation, the time shared servo is used to control the analog velocity of the take-up reel drive motor in the scanned one of the bill caches. At the same time, an open-loop, relatively low-level energization of the supply reel drive motor of the selected bill cache occurs (in the opposite direction so as to maintain web tension. A power transistor 535 cooperates with four of the power transistors shown in FIG. 23 to energize the take-up reel drive motor in the selected bill cache. A power transistor 536 cooperates with the remaining four of the power transistors shown in FIG. 23 to energize the supply reel drive motors in the selected bill cache.

While the existing command is a Forward command, power transistor 535 operates as part of the time shared servo whereas power transistor 536 operates on an open-loop basis. On the hand, while the existing command is either a Reverse or an Unload command, power transistor 536 operates as part of the time shared servo whereas power transistor 535 operates on an open loop basis.

While power transistor 535 operates as part of the time shared servo, the summing junction for the time shared servo is 'In' summing junction 537. Between 'In' summing junction 537 and the base electrode of power transistor 535 there is an amplifier generally indicated at 538. While power transistor 536 operates as part of the time shared servo, the summing junction for the time shared servo is 'Out' summing junction 539. Between 'Out' summing junction 539 and the base electode of power transistor 536 there is an amplifier generally indicated at 540.

Those skilled in the art should recognize that the present invention has a number of functional advantages over prior art devices. It is theft proof to an unusual degree. It is difficult to carry off the premises. The operator cannot be forced to empty the contents. The inventive Terminal will only give change to bills over the amount of the sale. The Terminal will only accept the bill necessary to equal or exceed the amount of the sale. An operator must make decisions about the denomination and genuineness of bills but cannot touch the bills. In food operations this function may eliminate the need for an extra employee. In all operations the inability of the employees to have access to cash is an important anti-theft feature. Both the management and the employees of the firm employing a Terminal incorporating in it the inventive features shown herein gain security, safety and accuracy.

The present invention is shown and described with two alternate modes of implementation—a software mode and a hardware mode. Both modes are shown in conjunction with a microprocessor. At the time this application is filed, the inventors do not know what mode of implementation will be employed. It is very possible that the present invention will be manufactured and sold as a stand-alone device to interconnect with existing in-place point-of-sale terminals.

Accordingly, the inventors recognize that those skilled in the art to which the present invention relates understand that there are many variations possible in the structures shown and described in this application. These structures are shown as illustrations only and not in limitation of the inventive concepts described herein.

We claim:

1. In a cash handling apparatus comprising in combination: a housing means having a top, bottom, front, back, and side surfaces; said front surface having at least one input-output channel formed therein for receiving and dispensing bills; said top surface having at least one viewing window formed therein; at least one transparent money belt means having two belt members contained within said housing means; at least two driven unstoring reel means and at least one driven storing reel means for driving each of the transparent money belt means; the money belt means disposed within the housing such that a bill is transported by the money belt means from the input-output channel to a position opposite the viewing window prior to reaching the storing reel.

2. The device claimed in claim 1 including further: bill sensing means in said housing for detecting the presence of a bill; the sensing means disposed adjacent to the viewing window and between the viewing window and the input-output channel means.

3. The device claimed in claim 1 or 2 including further: said input-output channel having an input end; a second bill sensing means disposed at the input end of input channel for sensing the leading edge of a bill entering the channel and the trailing edge of a bill leaving the channel.

4. The device claimed in claim 1 wherein: there is a plurality of input-output channel means and there is a viewing window and a money belt means for each input-output channel.

5. The device claimed in claim 1 including further: a third bill sensing means disposed in the housing.

6. The device claimed in claim 1 wherein: the viewing window is positioned in the top surface of the housing means to be viewed by a person positioned adjacent the front and back surface of the housing means.

7. The device claimed in claim 2 including further: control means for controlling the operation of said unstoring reels and said storing reel; reversible motor means for actuating said storing and unstoring reel means; said bill sensing means having first, second, and third detector members disposed in said housing; said first detector member disposed near the input-output channel, said second detector member disposed intermediate the input-output channel and the viewing window, said third detector member disposed downstream of the viewing window and the second detector member; said detector members providing location signals to the control means; time sensing means forming part of said control means; said first detector providing a signal to said control means in the presence of the leading edge of a bill to cause the control means to direct the storage reel means to rotate in the storing direction; said second detector member active to send a signal to said control means when the presence of said leading edge of the bill is detected, if the signal from said second detector member reaches said control means within a predetermined period of time measured by said time sensing means said control means continues to direct the rotation of the storage reel means in the storing direction, if no leading edge is sensed within the predetermined period of time, the control means causes the storage reel means to stop rotating in the storing direction: said second detector member operative to cause the control means to stop the rotation of the storage reel means in the storing direction with the bill in front of the viewing window.

8. The device claimed in claim 7 including further an operator controlled actuation means for driving the storage reel means in either the storing or the unstoring direction after the bill has been examined by the operator at the viewing window.

9. The device claimed in claim 7 wherein said detection members are comprised of optical generator and detector members.

10. The device claimed in claim 7 wherein said reel means include an electric motor and speed sensor for controlling the speed of the motor and the tension applied to the belt members.

11. The device claimed in claim 7 wherein there are at least two money belt means each having its associated viewing window and input-output channel means; said money belt means are designated to accept different denominations of bills; the control means is operative to permit bills on all the money belt means to be positioned in a stored condition after the viewing station; the control means is operative to permit only certain money belt means to be driven in the unstoring direction sufficient distance to allow a bill to be taken from the stored condition to the input-output channel.

12. The device claimed in claim 7 wherein: there are at least two money belt means, viewing window and input-output channels; a signal means is associated with each money belt means and viewing window; said bill sensing means produces a signal means when the leading edge of a bill is sensed by said first detector member.

13. The device claimed in claim 12 wherein said signal means is actuated by said control means in response to a signal from said bill sensing means when said first detector member senses the presence of the trailing edge of a bill.

14. In a cash handling apparatus to receive and dispense bills the combination comprising: a housing means having top, front, and back surfaces; a viewing window member formed in the top surface having a window larger than the physical size of the cash to be viewed; a plurality of input-output slot members formed in the front surface of the housing means; a plurality of money belt means contained within the housing and adapted to transport cash from the input-output slot members to the viewing windows; each slot member, viewing window and money belt means forming a bill handling combination for bills moving in a stream from the slot to the viewing window, upstream to downstream; first, second and third bill detector means associated with each money belt means; the first detector means located near the downstream end of the slot member, the second detector means located downstream of the first detector means but upstream of the viewing window, the third detector means located downstream of the second detector means and of the viewing window; signal means associated with each money belt means; automatic operator controlled input means; control means for processing the various signals received from the detector means and the operator controlled input means; the money belt means having a plurality of transparent belt members, a plurality of unstoring reels, a storing reel and drive means for controlling the actuation of the storing reels and unstoring reel; the drive means input determined by the control means responsive to the signals received from the detector members and the operator controlled input means; said drive means operative to receive bills after an appropriate signal from the operator controlled input means; said drive means operative to dispense bills only after an appropriate signal from said control means; said control means having a memory means, a sequencing means and a logic means.

15. The apparatus of claim 14 wherein said detector members have optical input and output members to optically sense the presence of the bills.

16. The apparatus of claim 14 including further a signal means associated with each belt means for informing the operator of the apparatus which of said belt means is receiving a bill.

17. The apparatus of claim 14 wherein less than all of said belt means can be actuated to dispense bills.

18. The apparatus of claim 14 including further an optical sensor means associated with each of said belt means for determining the opacity to light of a bill.

19. A method for operating a cash handling device for receiving and dispensing bills in which the device has a plurality of operator controlled keys, at least one money input channel means for receiving money and associated sensors, and at least one viewing window contained in a housing comprising the steps of: ascertaining the total charge of a sales transaction by actuating one of the keys; observing the presence of a bill in an input channel; verifying the genuineness and denomination of the bill previously placed in the channel while observing the bill through the viewing window; accepting or rejecting the bill by actuating the appropriate key; repeating the above steps until the device itself indicates that the total of accepted money equals or exceeds the amount of the transaction.

20. The method claimed in claim 19 wherein the device has at least two input channel means and at least two viewing windows including the further steps of recognizing the denomination of the bill tendered and that it is in the correct input channel means and actuating the correct key (keys).

21. The method claimed in claim 19 including the further step of observing a signal from the device which indicates the money belt receiving a bill and then observing in the associated viewing window the bill so transported.

22. The method claimed in claim 20 including the further steps of entering into the cash handling device through the keyboard the denomination of the bill viewed through the window.

* * * * *